US011101594B2

(12) United States Patent
Nozaki et al.

(10) Patent No.: US 11,101,594 B2
(45) Date of Patent: Aug. 24, 2021

(54) CONNECTOR

(71) Applicants: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

(72) Inventors: Shinji Nozaki, Mie (JP); Yasuo Omori, Mie (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/958,005

(22) PCT Filed: Dec. 24, 2018

(86) PCT No.: PCT/JP2018/047404
§ 371 (c)(1),
(2) Date: Jun. 25, 2020

(87) PCT Pub. No.: WO2019/138852
PCT Pub. Date: Jul. 18, 2019

(65) Prior Publication Data

US 2021/0066845 A1 Mar. 4, 2021

(30) Foreign Application Priority Data

Jan. 12, 2018 (JP) ..... JP2018-003166

(51) Int. Cl.
*H01R 13/514* (2006.01)
*H01R 13/627* (2006.01)

(52) U.S. Cl.
CPC ..... *H01R 13/514* (2013.01); *H01R 13/6271* (2013.01)

(58) Field of Classification Search
CPC .. H01R 13/514; H01R 13/516; H01R 13/518; H01R 13/627; H01R 13/6271
(Continued)

(56) References Cited

U.S. PATENT DOCUMENTS 5,951,306 A 9/1999 Millhimes
6,126,481 A * 10/2000 Wu ..... H01R 13/514 439/541.5
(Continued)

FOREIGN PATENT DOCUMENTS

JP 08-031499 2/1996
JP 10-032060 2/1998
(Continued)

OTHER PUBLICATIONS

Official Communication issued in International Bureau of WIPO Patent Application No. PCT/JP2018/047404, dated Mar. 5, 2019.

*Primary Examiner* — Khiem M Nguyen
(74) *Attorney, Agent, or Firm* — Greenblum & Bernstein, P.L.C.

(57) ABSTRACT

A connector includes a wire harness, and a connector main body to which the wire harness is attached. The connector main body includes a first substrate stack in which a plurality of first substrates are held in a vertically stacked state, a first bottom substrate that forms the lowermost first substrate of the first substrate stack and includes a coupling post extending upward from an upper face, and a second substrate stack that is arranged on a lateral side of the first substrate stack and in which a plurality of second substrates are held in a vertically stacked state. At least one of the plurality of second substrates included in the second substrate stack is provided with a coupling hole (a through hole provided in
(Continued)

the second substrates of the second layer, the fourth layer, and the sixth layer) that can be fitted to the coupling post (a right post).

8 Claims, 21 Drawing Sheets

(58) Field of Classification Search
USPC ..... 439/660, 701
See application file for complete search history.

(56) References Cited

U.S. PATENT DOCUMENTS

| | | | | |
|---|---|---|---|---|
| 10,170,874 | B1 * | 1/2019 | Costello | H05K 1/11 |
| 2017/0125955 | A1 | 5/2017 | Higashikozono et al. | |

FOREIGN PATENT DOCUMENTS

| | | |
|---|---|---|
| JP | 2006-012501 | 1/2006 |
| JP | 2012-238531 | 12/2012 |
| JP | 2015-165478 | 9/2015 |

* cited by examiner

CONNECTOR

TECHNICAL FIELD

The present invention relates to a connector.

BACKGROUND ART

Patent Document 1 discloses a connector including a substrate stack obtained by stacking a plurality of substrates in the vertical direction. With this connector, a plurality of substrates can be integrated. Furthermore, in recent years, it is not uncommon to use a plurality of such substrate stacks, and there is demand for integration of a plurality of substrate stacks.

Here, Patent Document 2 discloses a connector in which a plurality of sub-connectors are integrated via a frame. It is conceivable to utilize this technique to integrate a plurality of substrate stacks via a frame.

CITATION LIST

Patent Document

Patent Document 1: JP 2015-165478A
Patent Document 2: JP 2006-012501A

SUMMARY OF INVENTION

Technical Problem

However, integrating a plurality of substrate stacks via a frame is problematic in that the size of the connector increases by the size of the frame.

The present invention was made in view of the above-mentioned conventional circumstances, and a problem to be solved is to provide a connector with which a plurality of substrate stacks can be integrated without the need for an additional member such as a frame.

Solution to Problem

A connector of the present invention includes:

a wire harness; and a connector main body to which the wire harness is attached, wherein the connector main body includes:

a first substrate stack in which a plurality of first substrates are held in a vertically stacked state;

a first bottom substrate that forms the lowermost first substrate of the first substrate stack and includes a coupling post extending upward from an upper face; and a second substrate stack that is arranged on a lateral side of the first substrate stack and in which a plurality of second substrates are held in a vertically stacked state, and at least one of the plurality of second substrates included in the second substrate stack is provided with a coupling hole that can be fitted to the coupling post.

Advantageous Effects of Invention

With the present invention, fitting the coupling hole provided in the second substrate included in the second substrate stack to the coupling post provided on the first bottom substrate makes it possible to couple the first substrate stack and the second substrate stack side by side without using an additional member such as a frame.

Figure 1:
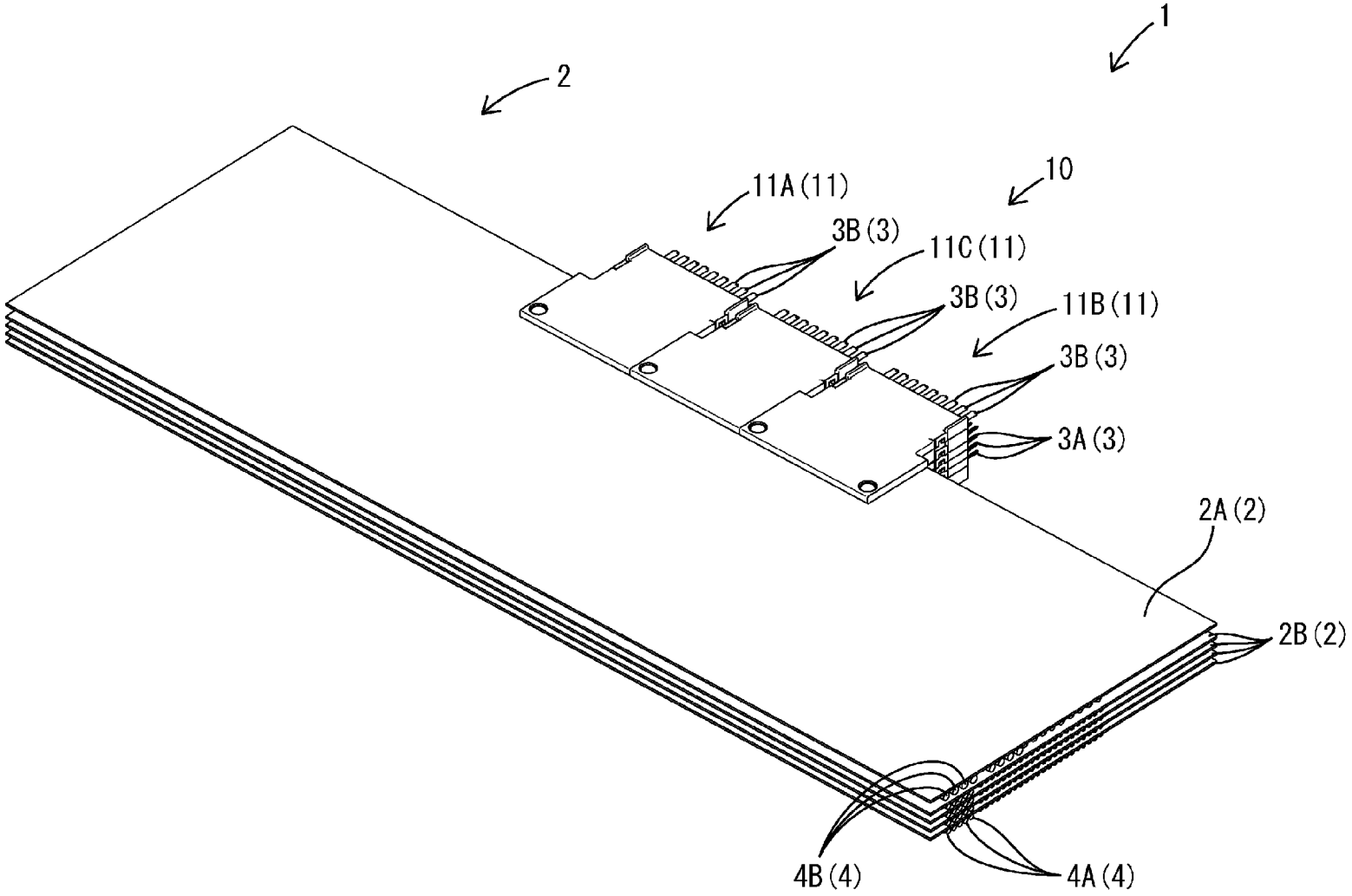
FIG. 1 is a perspective view of a connector of Embodiment 1.

DESCRIPTION OF EMBODIMENTS (1) The connector of the present invention may also have a configuration in which at least one of the plurality of first substrates included in the first substrate stack is stacked in a non-interfered state as a layer located at the same height as the second substrate that is not provided with the coupling hole, and is provided with a first reinforcement hole that can be fitted to the coupling post.

With this configuration, the stacked state of the first substrate stack can be firmly maintained by utilizing the coupling post. Moreover, fitting the second substrate provided with the coupling hole and the first substrate provided with the first reinforcement hole alternately to the coupling post makes it possible to improve the rigidity of the coupling portion where the first substrate stack and the second substrate stack are coupled to each other because the first substrate and the second substrate overlap each other in the vertical direction.

(2) The connector of the present invention may also have a configuration in which the connector main body includes: an addition substrate stack that can be arranged between the first substrate stack and the second substrate stack and in which a plurality of addition substrates are held in a vertically stacked state; and an addition bottom substrate that forms the lowermost addition substrate of the addition substrate stack, at least one of the plurality of addition substrates included in the addition substrate stack is provided with an addition hole that can be fitted to the coupling post, and the addition bottom substrate includes an addition post that extends upward from an upper face and to which the coupling hole can be fitted.

With this configuration, fitting the addition hole provided in the addition substrate included in the addition substrate stack to the coupling post provided on the first bottom substrate makes it possible to couple the first substrate stack and the addition substrate stack side by side without using an additional coupling member. Furthermore, fitting the coupling hole provided in the second substrate included in the second substrate stack to the addition post provided in the addition substrate stack makes it possible to couple the addition substrate stack and the second substrate stack side by side without using an additional coupling member. Accordingly, three substrate stacks can be coupled side by side without using additional coupling members.

(3) The connector of the present invention may also include a plurality of the addition substrate stacks and have a configuration in which the addition hole of one of the adjacent two addition substrate stacks can also be fitted to the addition post of the other addition substrate stack.

With this configuration, fitting the addition hole provided in the addition substrate included in one of the adjacent two addition substrate stacks to the addition post provided on the addition substrate included in the other addition substrate stack makes it possible to couple the addition substrate stacks side by side without using an additional coupling member. Accordingly, four or more substrate stacks can be coupled side by side without using additional coupling members and increasing the number of types of members.

(4) The connector of the present invention may also have a configuration in which at least one of the plurality of first substrates included in the first substrate stack is stacked in a non-interfered state as a layer located at the same height as the addition substrate that is not provided with the addition hole, and is provided with a second reinforcement hole that can be fitted to the coupling post.

With this configuration, the stacked state of the first substrate stack can be more firmly maintained by utilizing the coupling post. Moreover, fitting the first substrate provided with the first reinforcement hole and the addition substrate provided with the addition hole alternately to the coupling post makes it possible to improve the rigidity of the coupling portion where the first substrate stack and the addition substrate stack are coupled to each other because the first substrate and the addition substrate overlap each other in the vertical direction.

(5) The connector of the present invention may also have a configuration in which the wire harness has a configuration in which an electric wire connected to a terminal fitting is fixed to a sheet-like member, and is attached to the connector main body by passing the coupling post through the sheet-like member.

With this configuration, the wire harness can be attached to the connector main body without using a fixture.

(6) The connector of the present invention may also have a configuration in which the first substrate stack includes a locking portion that locks the first substrates included in the first substrate stack together at a position at which the locking portion does not interfere with the wire harness in which the coupling post passes through the sheet-like member, and prevents the first substrates from being displaced relative to each other.

With this configuration, it is possible to avoid interference between the locking portion and the wire harness.

(7) The connector of the present invention may also have a configuration in which the locking portion includes: an elastic locking piece that extends upward in the form of a cantilever from the first substrate; and a locking protrusion that is provided on another first substrate stacked on the first substrate provided with the elastic locking piece and is locked to the elastic locking piece.

With this configuration, two vertically stacked first substrates are locked to each other in a state in which the extending end portion (free end) of the elastic locking piece faces upward, and thus the first substrate stack is formed. Therefore, the locking state can be cancelled by hooking a fingernail on the upper end portion of the elastic locking piece, thus making it easy to remove the stacked first substrates from above.

Embodiment 1

Hereinafter, Embodiment 1 in which the present invention is embodied will be described with reference to FIGS. 1 to 21. It should be noted that, regarding the front-rear direction, a side indicated by a direction in which a connector 1 is fitted into a counterpart connector (not shown) (upper side in FIG. 2) is defined as the "front side", and a side indicated by the opposite direction is defined as the "rear side". The direction in which substrates 12 are stacked is defined as the "vertical direction". Regarding the left-right direction, the left side and the right side of the connector 1 as viewed from the rear side are defined as the "left side" and the "right side", respectively.

Connector 1

Figure 2:
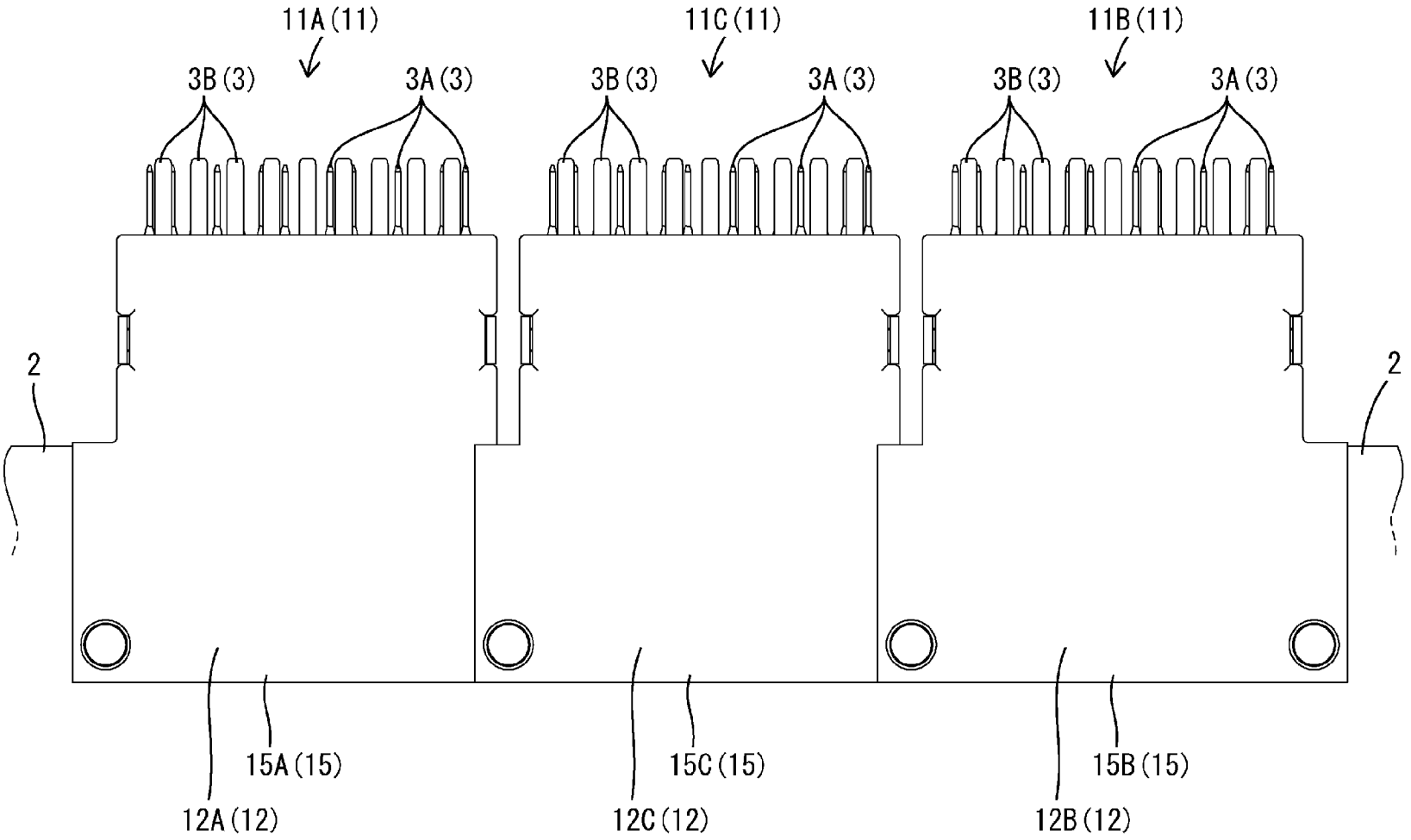
FIG. 2 is a plan view of the connector.
Figure 3:
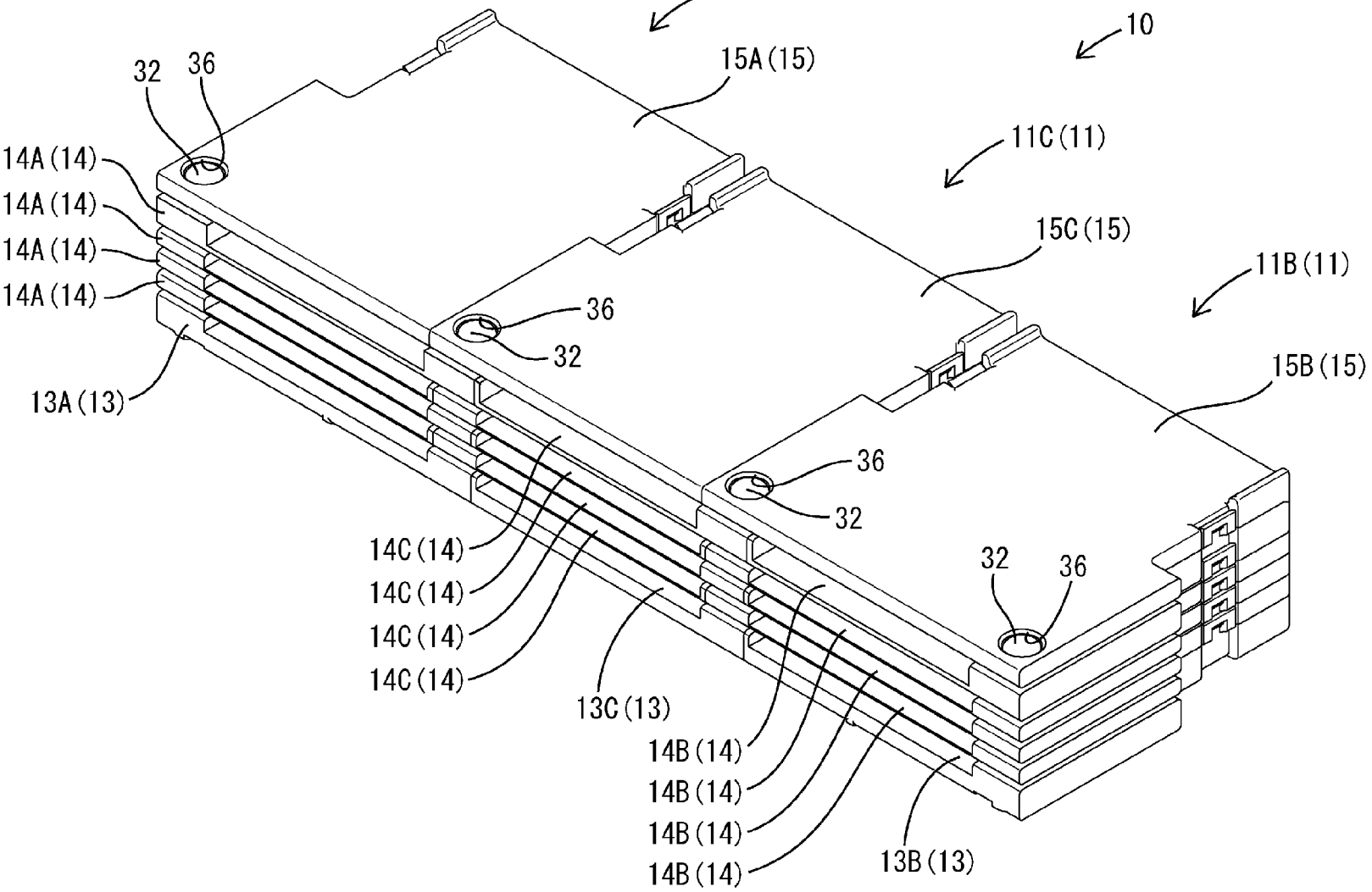
FIG. 3 is a perspective view of a connector main body.
Figure 4:
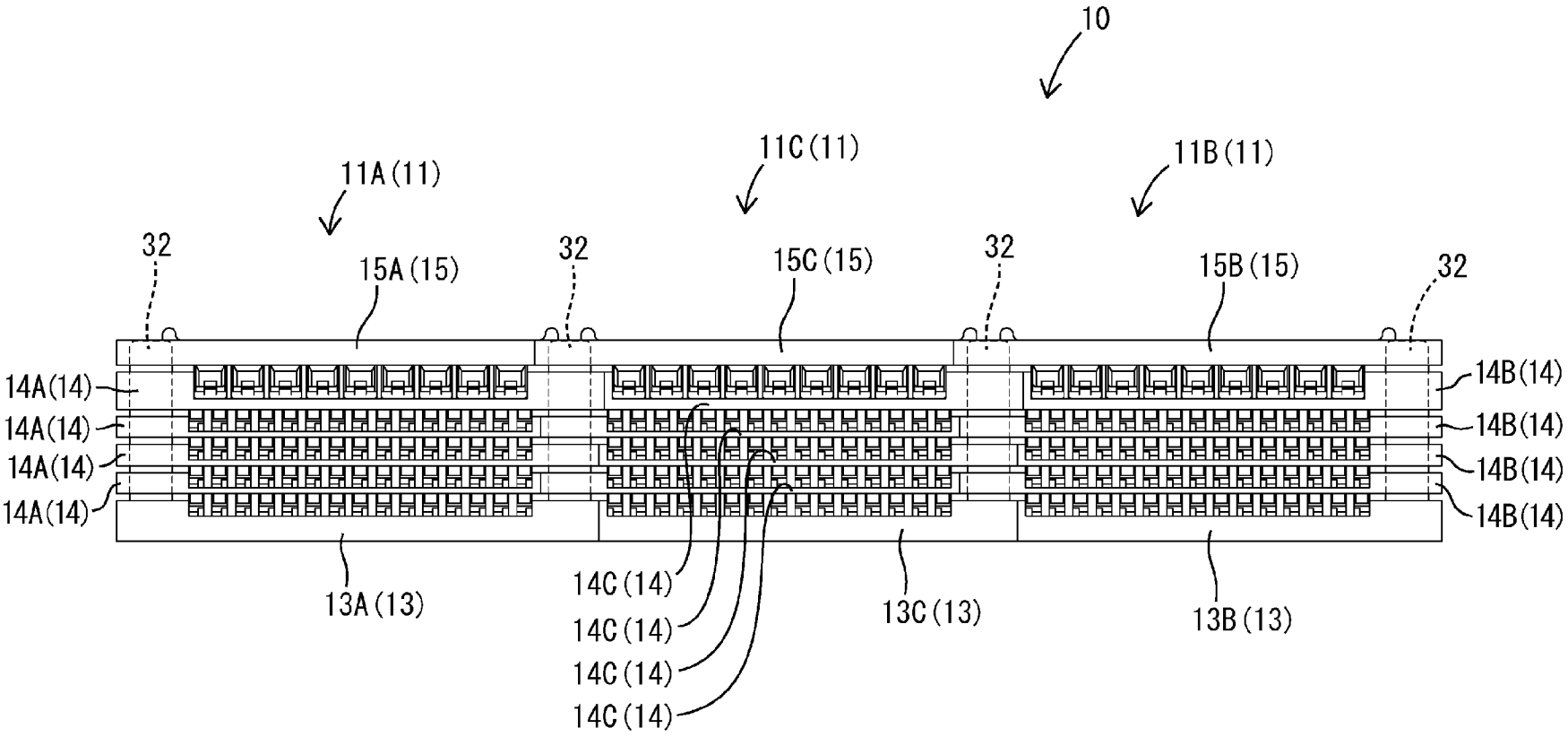
FIG. 4 is a front view of the connector main body.
Figure 5:
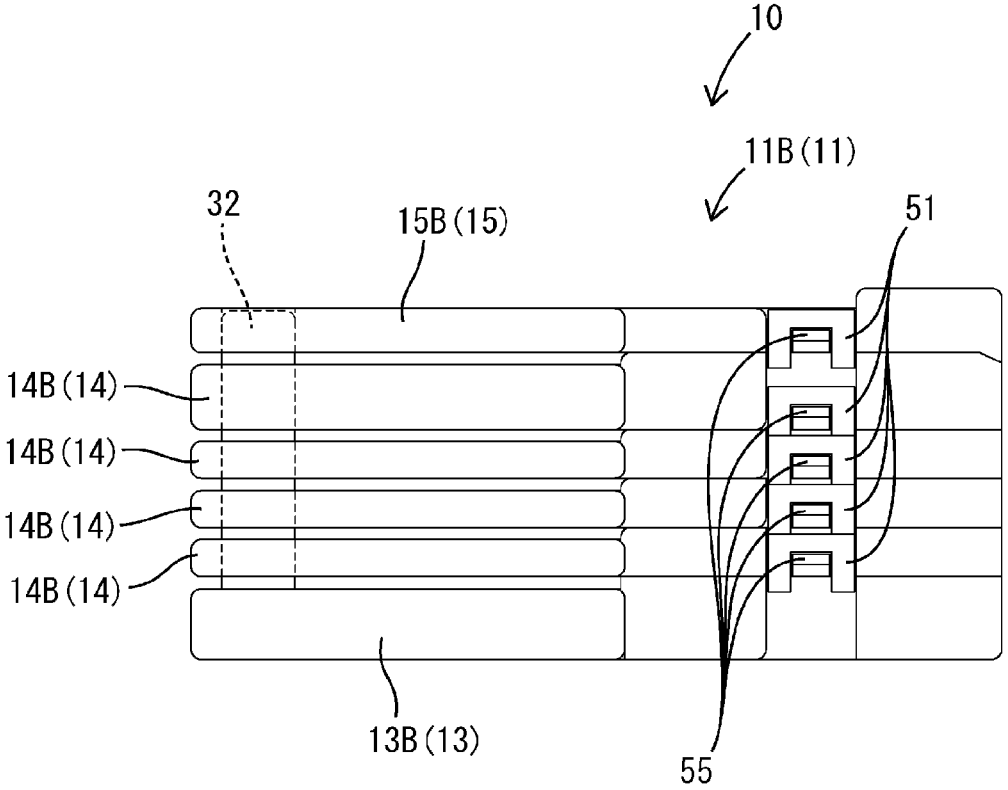
FIG. 5 is a right side view of the connector main body.
Figure 6:
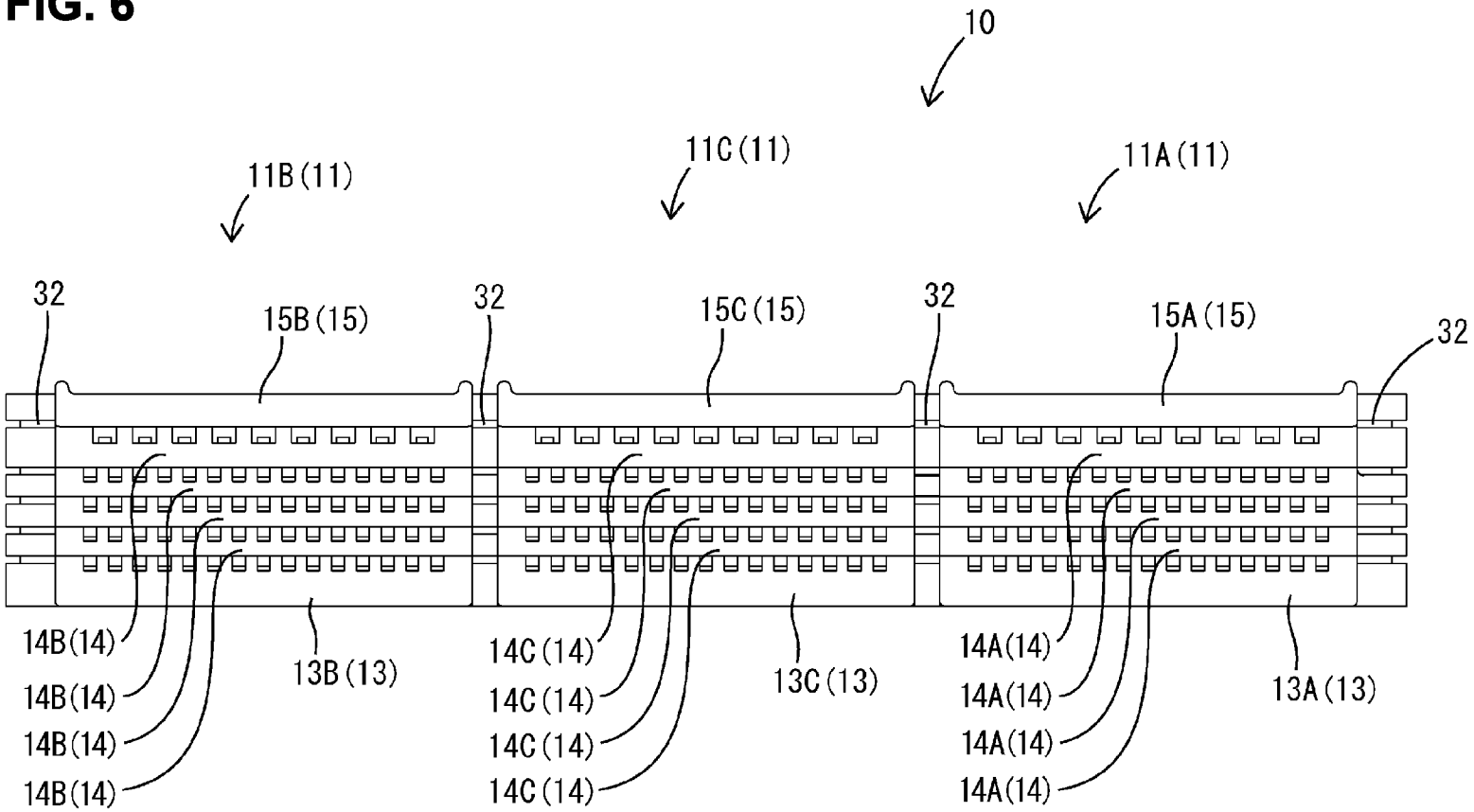
FIG. 6 is a rear view of the connector main body.
Figure 7:
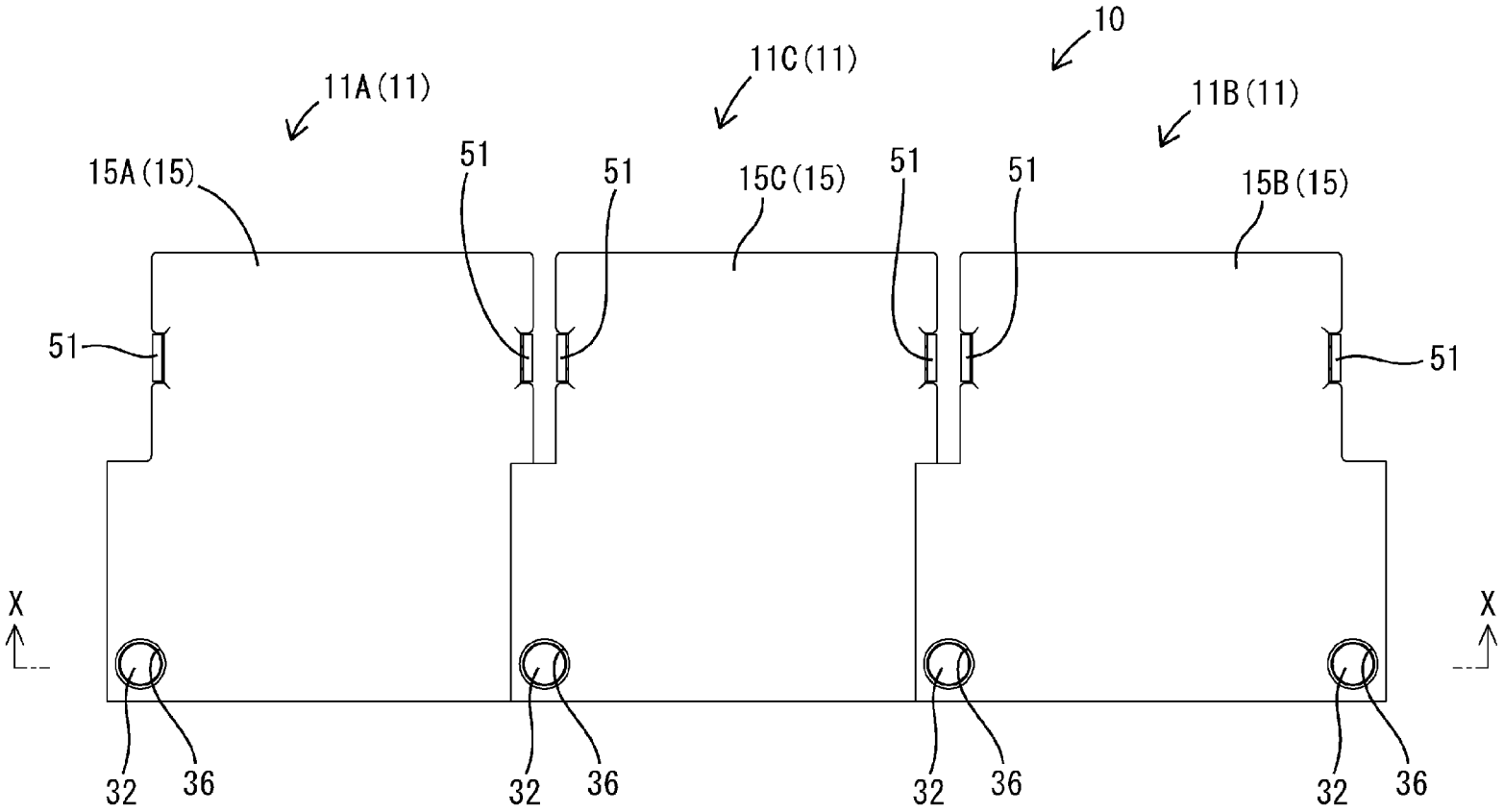
FIG. 7 is a plan view of the connector main body.
Figure 8:
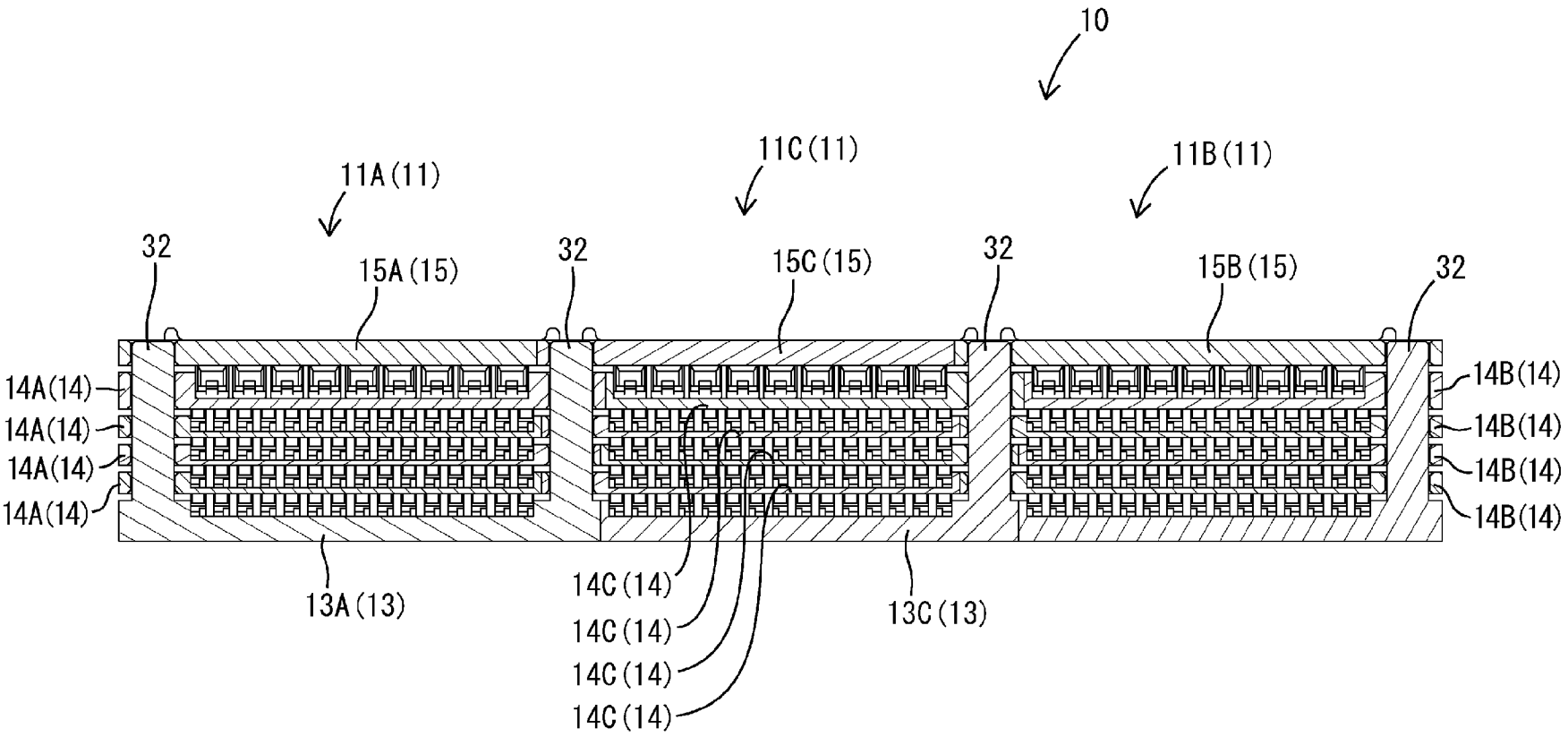
FIG. 8 is a cross-sectional view of the connector main body taken along line X-X.

As shown in FIGS. 1 and 2, a connector 1 of Embodiment 1 includes a plurality of wire harnesses 2, and a connector main body 10 made of a synthetic resin to which the plurality of wire harnesses 2 are attached. Each of the wire harnesses 2 has a configuration in which a plurality of electric wires 4 that are respectively connected to a plurality of terminal fittings 3 are fixed to (sewn on) a sheet-like member 5 made of a nonwoven fabric or the like that is arranged substantially horizontally. The electric wires 4 are arranged extending along the underside of the sheet-like member 5. The terminal fittings 3 are fixed in a state of protruding from an edge of the sheet-like member in the horizontal direction (i.e., a direction parallel with the plane of the sheet-like member 5).

As the wire harnesses 2, a plurality of types of wire harnesses such as wire harnesses 2A and 2B that differ in the widths of the terminal fittings 3 and the electric wires 4 are provided. A first wire harness 2A includes first terminal fittings 3A with a relatively small width (e.g., a width of 0.5 mm), and first electric wires 4A with a small diameter connected to the first terminal fittings 3A. A second wire harness 2B includes second terminal fittings 3B with a relatively large width (e.g., a width of 1.5 mm), and second electric wires 4B with a large diameter connected to the second terminal fittings 3B.

As shown in FIGS. 1 to 8, the connector main body 10 has a configuration in which a plurality of substrate stacks 11 that each include a plurality of substrates 12 held in a vertically stacked state are coupled side by side. A first substrate stack 11A and a second substrate stack 11B that can be coupled laterally to the first substrate stack 11A are provided as the substrate stacks 11. Furthermore, an addition substrate stack 11C that can be arranged between the first substrate stack 11A and the second substrate stack 11B and to which the first substrate stack 11A and the second substrate stack 11B can be coupled laterally is provided as the substrate stack 11. Also, the addition substrate stack 11C is configured such that addition substrate stacks 11C can be coupled side by side. Therefore, a user can adjust the number of substrate stacks 11 included in the connector main body 10 to any desired number greater than or equal to two by increasing or reducing the number of the addition substrate stacks 11C. It should be noted that a method for coupling the substrate stacks 11 will be described later in detail.

The substrates 12 included in the substrate stack 11 are classified into a bottom substrate 13 forming the lowermost substrate 12 of the substrate stack 11, an upper substrate 14 stacked on or above the bottom substrate 13, and a cover substrate 15 forming the uppermost substrate 12 of the substrate stack 11. That is to say, the first substrate stack 11A includes a plurality of first substrates 12A (i.e., a first bottom substrate 13A, a plurality of first upper substrates 14A, and a first cover substrate 15A). The second substrate stack 11B includes a plurality of second substrates 12B (i.e., a second bottom substrate 13B, a plurality of second upper substrates 14B, and a second cover substrate 15B). The addition substrate stack 11C includes a plurality of addition substrates 12C (i.e., an addition bottom substrate 13C, a plurality of addition upper substrates 14C, and an addition cover substrate 15C).

Types of Bottom Substrate 13

Figure 9:
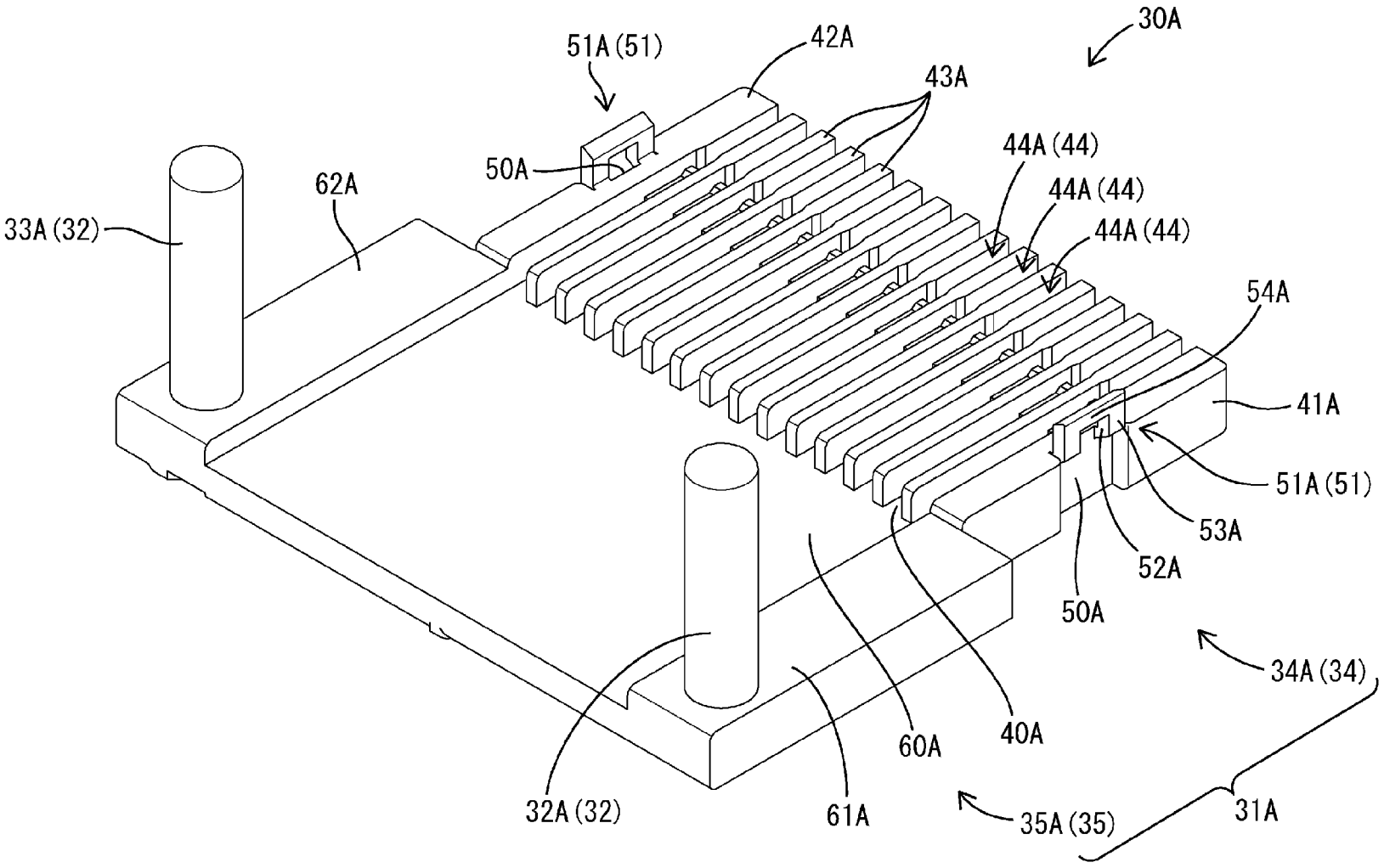
FIG. 9 is a perspective view of a type-1 bottom substrate.
Figure 10:
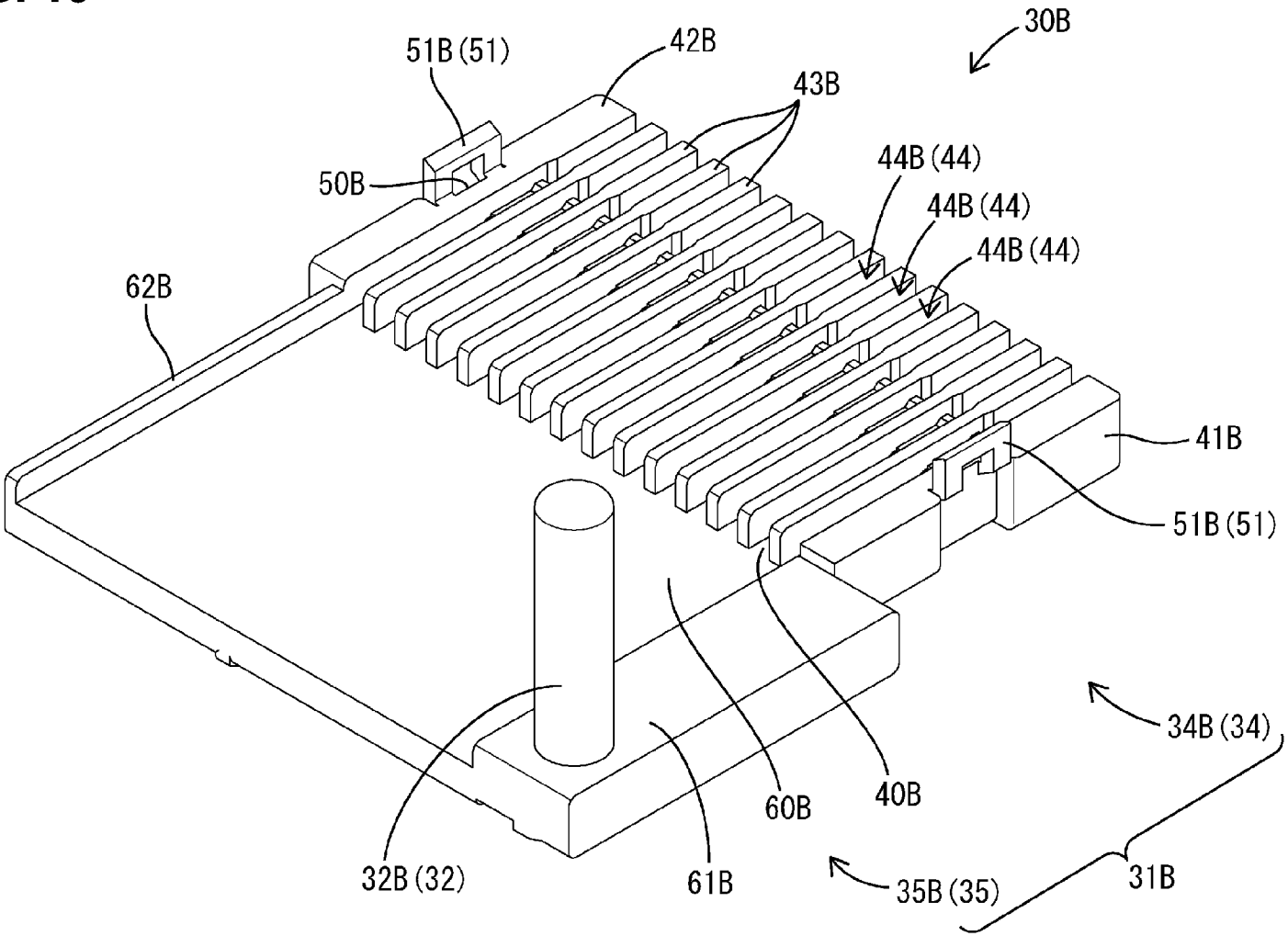
FIG. 10 is a perspective view of a type-2 bottom substrate.

As shown in FIGS. 9 and 10, a type-1 bottom substrate 30A including posts 32 on both the left and right sides thereof and a type-2 bottom substrate 30B including a post 32 on only one of the left and right sides thereof (on the right side in Embodiment 1) are provided as the bottom substrates 13.

The type-1 bottom substrate 30A includes a main body portion 31A, and a right post 32A and a left post 33A that extend upward from the upper face of the main body portion 31A. The main body portion 31A has a flat shape, and has a substantially square shape in a plan view. The main body portion 31A includes a terminal accommodation portion 34A in which the terminal fittings 3 of the wire harness 2 are to be accommodated, and a sheet-like member placement portion 35A on which the sheet-like member 5 of the wire harness 2 is to be placed. The terminal accommodation portion 34A forms the approximate front half of the main body portion 31A. The sheet-like member placement portion 35A forms the approximate rear half of the main body portion 31A. The rear end portion of the terminal accommodation portion 34A is continuous with the front end portion of the sheet-like member placement portion 35A.

The terminal accommodation portion 34A includes a front base portion 40A having a flat shape, a right wall portion 41A extending upward from the right end portion of the front base portion 40A, a left wall portion 42A extending upward from the left end portion of the front base portion 40A, and a plurality of partition wall portions 43A that partition a space between the right wall portion 41A and the left wall portion 42A. The right wall portion 41A, the left wall portion 42A and the partition wall portions 43A are formed extending over the entire region of the terminal accommodation portion 34A in the front-rear direction. The upper end faces of the right wall portion 41A, the left wall portion 42A, and the partition wall portions 43A are substantially flush. Cavities 44A (cavities 44) in which the electric wires 4 of the wire harness 2 are to be accommodated are formed between the right wall portion 41A and the partition wall portion 43A, between the partition wall portions 43A, and between the partition wall portion 43A and the left wall portion 42A. In each cavity 44A, the width in the left-right direction of a portion located on the front side is smaller than that of a portion located on the rear side.

It should be noted that FIGS. 9 to 13 show substrates 12 in which first terminal fittings 3A with a width of 0.5 mm are accommodated as examples, but, if another substrate 12 provided with cavities 44A with a different width and a different height is prepared, terminal fittings 3 with a desired width can be accommodated.

A recessed portion 50A that is recessed inward is formed in the outer side face in the left-right direction (specifically, at the central portion in the front-rear direction of the outer side face in the left-right direction) of the right wall portion 41A. The recessed portion 50A is formed extending over the entire region of the right wall portion 41A in the vertical direction.

The terminal accommodation portion 34A includes an elastic locking piece 51A (elastic locking piece 51) that extends upward in the form of a cantilever. The elastic locking piece 51A is provided on the bottom face of the recessed portion 50A. The elastic locking piece 51A has a shape that protrudes outward in the left-right direction from the bottom face (more specifically, the upper end portion of the bottom face) of the recessed portion 50A, and then is bent and extends upward. The extending end portion is a free end. More specifically, the elastic locking piece 51A includes leg portions 52A that extend outward in the left-right direction from a portion on the front side and a portion on the rear side of the bottom face of the recessed portion 50A, upright portions 53A that are orthogonal to the leg portions 52A and extend upward therefrom, and a connection portion 54A that connects the upper end portions of the upright portions 53A to each other. The outer side faces in the left-right direction of the upright portions 53A and the connection portions 54A are substantially flush with the outer side face in the left-right direction of the right wall portion 41A. The upper face of the connection portion 54A is inclined downward toward the inner side of the type-1 bottom substrate 30A in the left-right direction. A gap is formed in the vertical direction between the underside of the connection portion 54A and the upper face of the right wall portion 41A. When one first substrate 12A is stacked on another, a locking protrusion 55, which will be described later, is fitted into this gap, and thus the first substrate 12A is locked to the substrate 12 thereunder so as not to be displaced relative to the substrate 12 thereunder. It should be noted that the elastic locking piece 51 and the locking protrusion 55 correspond to the "locking portion" of the present invention.

It should be noted that the left wall portion 42A is symmetrical to the right wall portion 41A. Therefore, a description of the shape of the left wall portion 42A is omitted. The left wall portion 42A is also provided with an elastic locking piece 51A that is symmetrical to the elastic locking piece 51A provided on the right wall portion 41A.

The sheet-like member placement portion 35A includes a rear base portion 60A that has a flat shape, a right rib 61A protruding upward from the upper face of the right end portion of the rear base portion 60A, and a left rib 62A protruding upward from the upper face of the left end portion of the rear base portion 60A. The upper face of the rear base portion 60A is continuous and flush with the upper face of the front base portion 40A.

The right rib 61A and the left rib 62A are formed extending over the entire region of the sheet-like member placement portion 35A in the front-rear direction. The front end portions of the right rib 61A and the left rib 62A are continuous with the rear end portions of the right wall portion 41A and the left wall portion 42A, respectively. The upper rear edges of the right rib 61A and the left rib 62A are chamfered. The inner side faces of the right rib 61A and the left rib 62A are flush with the inner side faces of the right wall portion 41A and the left wall portion 42A, respectively. The outer side faces of the right rib 61A and the left rib 62A protrude from the outer side faces of the right wall portion 41A and the left wall portion 42A, respectively.

The upper faces of the right rib 61A and the left rib 62A are located at the same height, and are located at positions lower than the upper face of the terminal accommodation portion 34A (the upper faces of the right wall portion 41A and the left wall portion 42A). The width in the left-right direction of the right rib 61A is larger than the diameter of the right post 32A. The width in the left-right direction of the left rib 62A is larger than the diameter of the left post 33A. The right post 32A is provided on the upper face of the right rib 61A (more specifically, on the upper face of the rear end portion of the right rib 61A). The left post 33A is provided on the upper face of the left rib 62A (more specifically, on the upper face of the rear end portion of the left rib 62A).

The type-2 bottom substrate 30B includes a main body portion 31B, and a right post 32B that extends upward from the upper face of the main body portion 31B. The main body portion 31B includes a terminal accommodation portion 34B, and a sheet-like member placement portion 35B. The terminal accommodation portion 34B has the same shape as that of the terminal accommodation portion 34A of the type-1 bottom substrate 30A. That is to say, the terminal accommodation portion 34B includes a front base portion 40B, a right wall portion 41B, a left wall portion 42B, partition wall portions 43B, cavities 44B (cavities 44), recessed portions 50B, and elastic locking pieces 51B (elastic locking pieces 51) that respectively have the same shapes as those of the front base portion 40A, the right wall portion 41A, the left wall portion 42A, the partition wall portions 43A, the cavities 44A, the recessed portions 50A, and the elastic locking pieces 51A of the terminal accommodation portion 34A of the type-1 bottom substrate 30A.

The sheet-like member placement portion 35B includes a rear base portion 60B, a right rib 61B, and a left rib 62B. The rear base portion 60B and the right rib 61B respectively have the same shapes as those of the rear base portion 60A and the right rib 61A of the type-1 bottom substrate 30A. The left rib 62B is different from the left rib 62A of the type-1 bottom substrate 30A in that the width in the left-right direction is smaller than the diameter of the left post 33A and the outer side face is recessed inward from the outer side face of the left wall portion 42B, otherwise the shapes of the other portions are the same as those of the left rib 62A of the type-1 bottom substrate 30A.

Types of Upper Substrate 14

Figure 11:
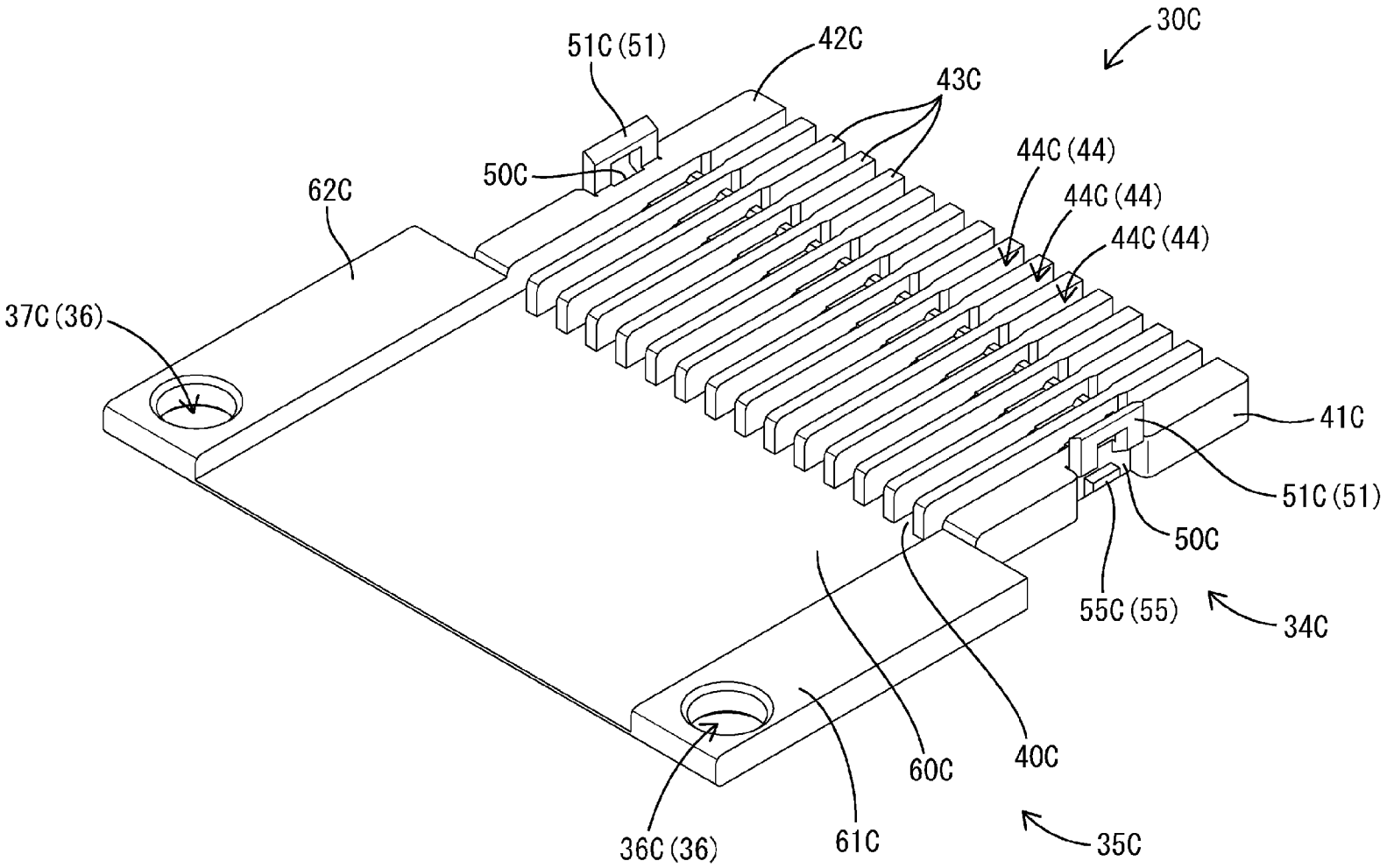
FIG. 11 is a perspective view of a type-1 upper substrate.
Figure 12:
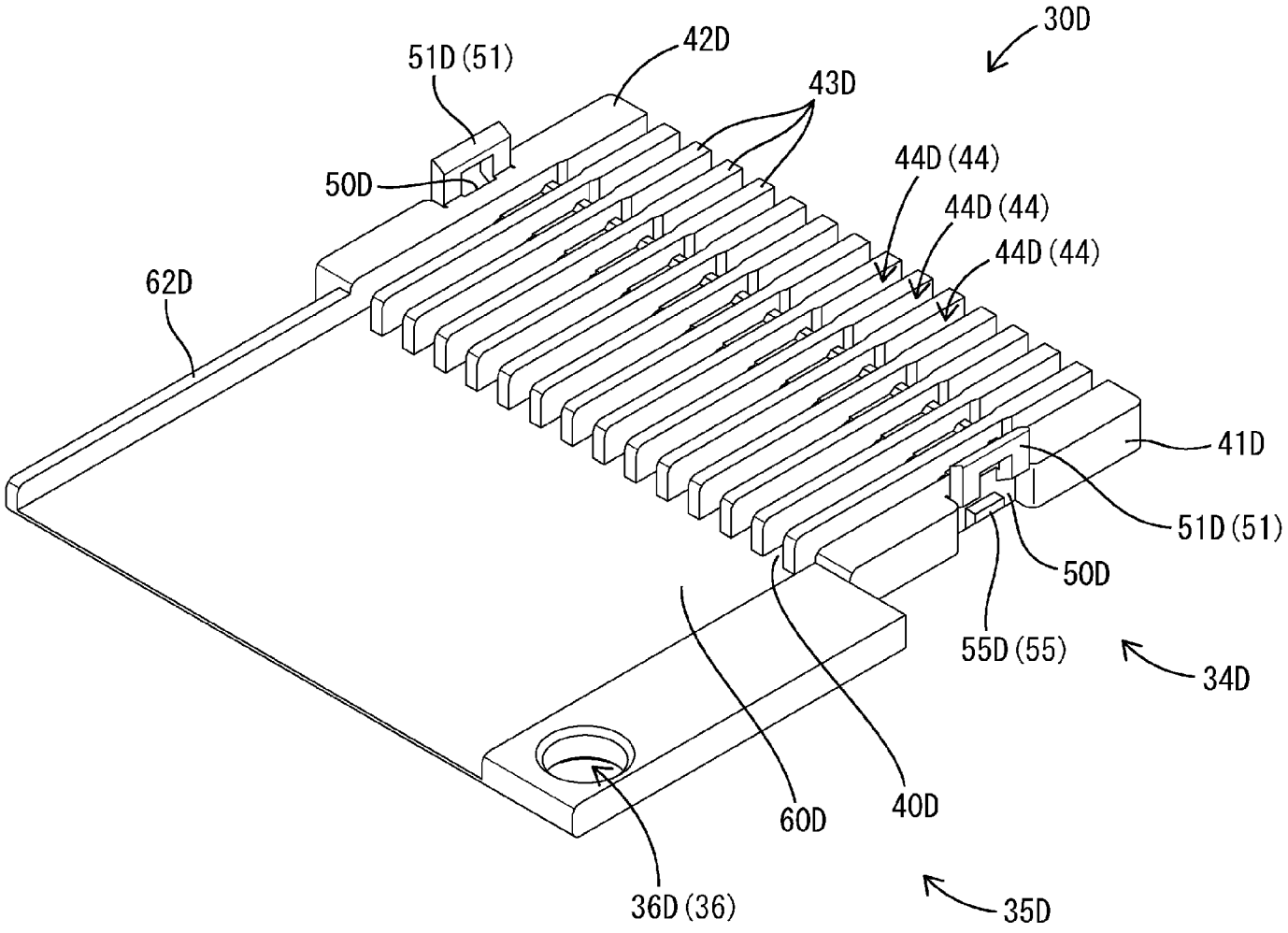
FIG. 12 is a perspective view of a type-2 upper substrate.
Figure 13:
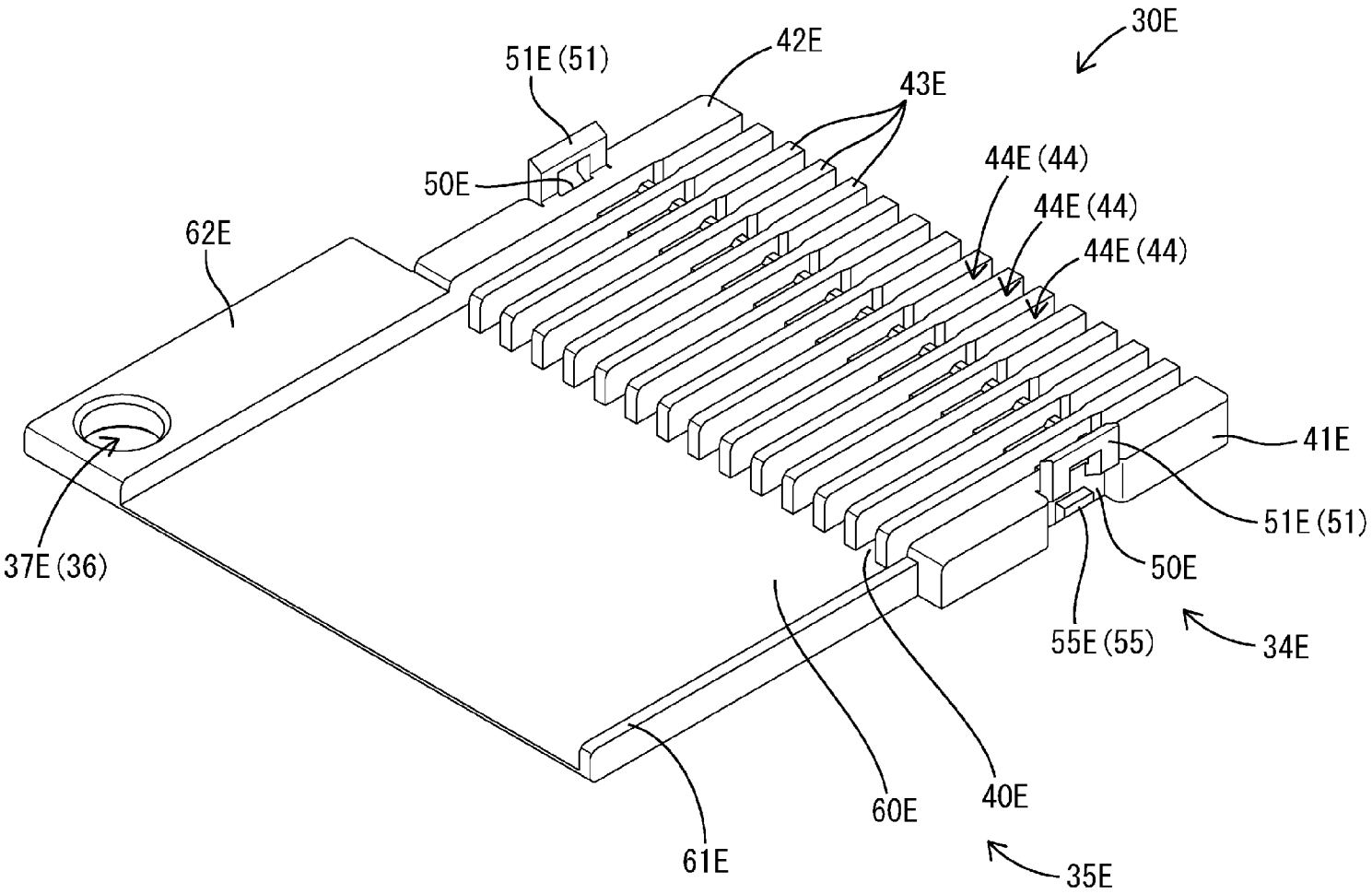
FIG. 13 is a perspective view of a type-3 upper substrate.
Figure 14:
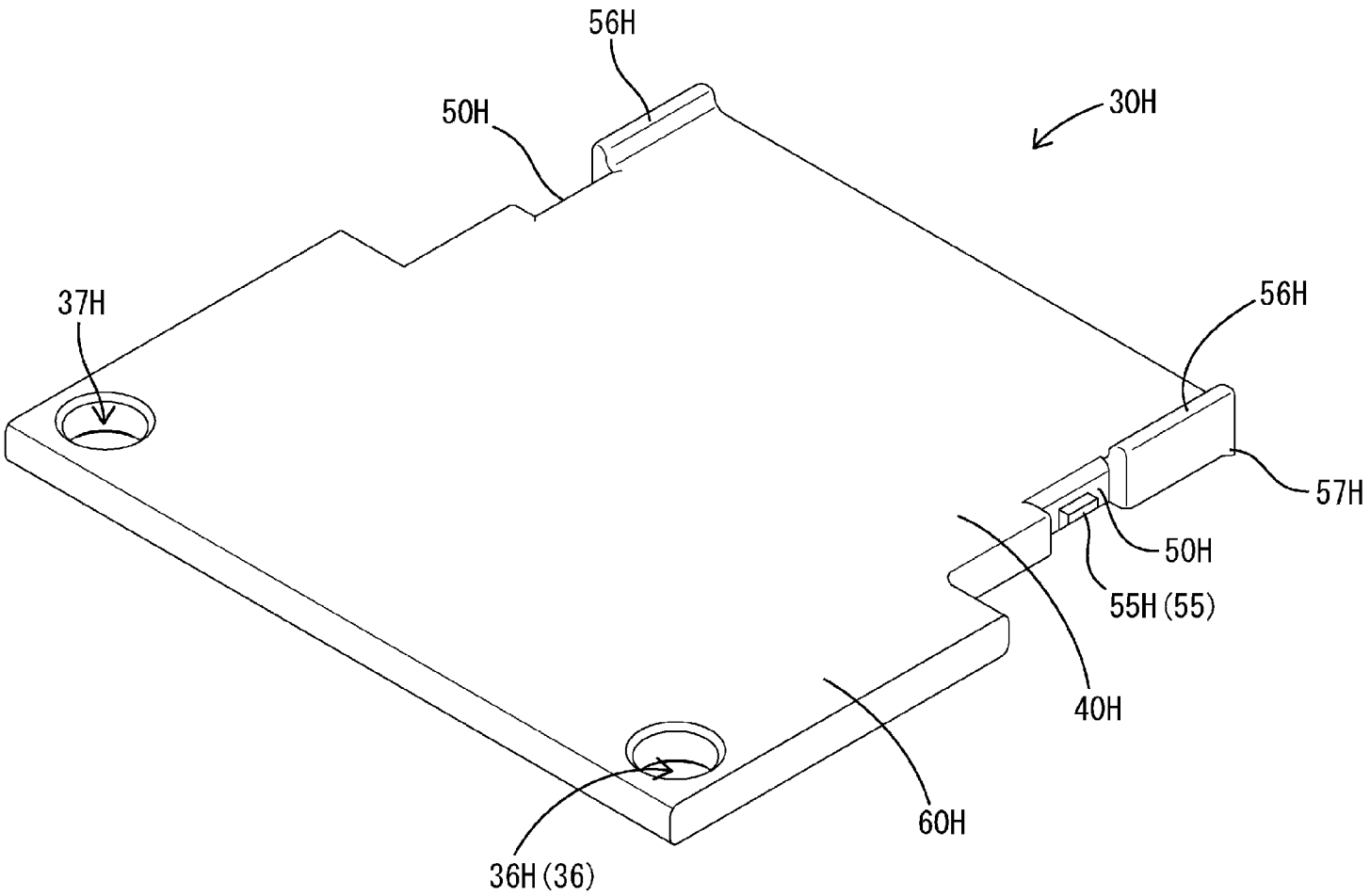
FIG. 14 is a perspective view of a type-1 cover substrate.
Figure 15:
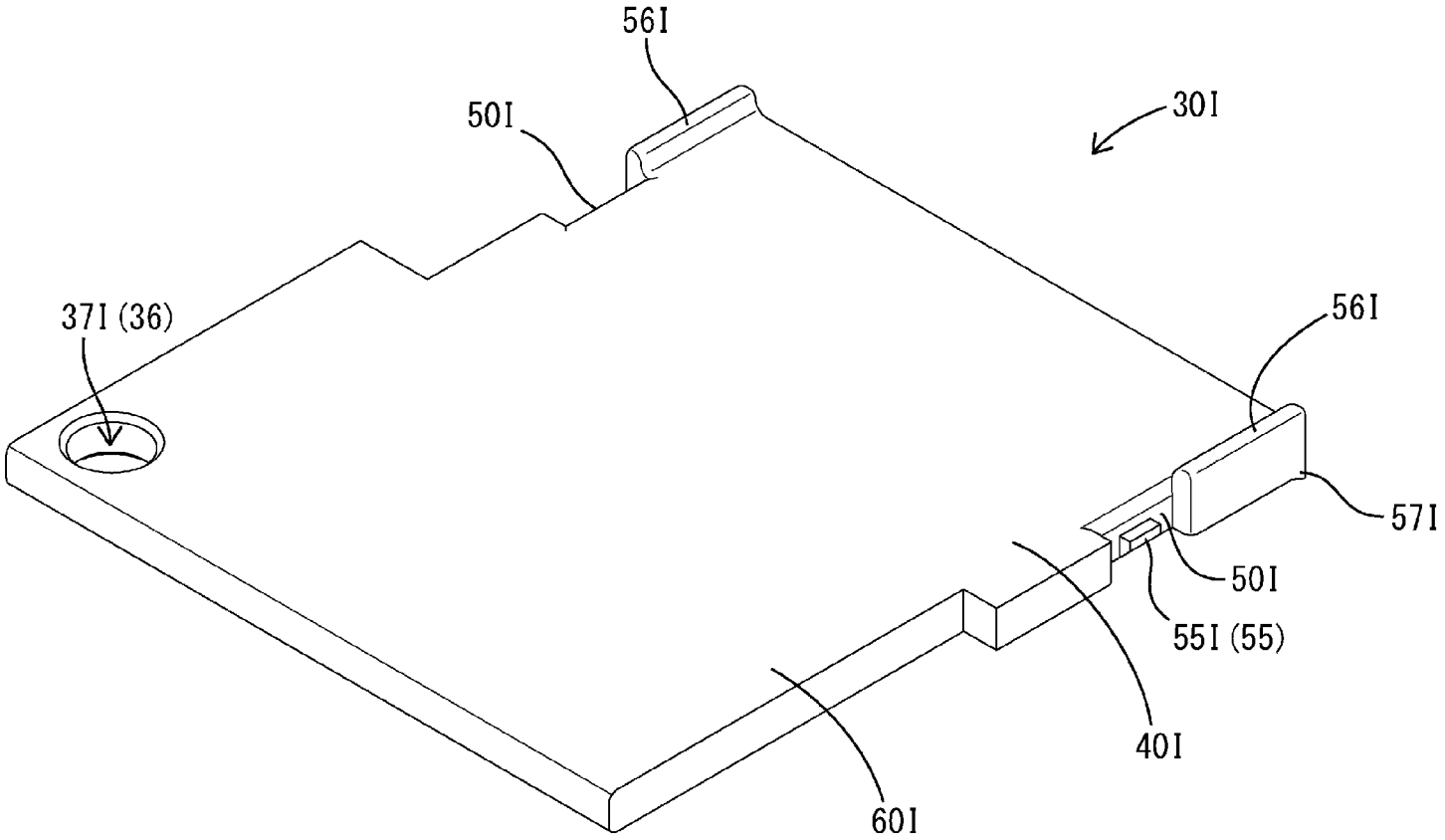
FIG. 15 is a perspective view of a type-2 cover substrate.

As shown in FIGS. 11 to 13, a type-1 upper substrate 30C provided with through holes 36 on both the left and right sides thereof, a type-2 upper substrate 30D provided with a through hole 36 on only the right side thereof, and a type-3 upper substrate 30E provided with a through hole 36 on only the left side thereof are provided as the upper substrates 14. All of the upper substrates 14 have a flat shape and are thinner than the plate portions (main body portions 31A and 31B) of the bottom substrates 13. The upper substrates 14 have a substantially square shape in a plan view.

The type-1 upper substrate 30C has substantially the same shape as that of the type-1 bottom substrate 30A in a plan view. The type-1 upper substrate 30C includes a terminal accommodation portion 34C and a sheet-like member placement portion 35C. The terminal accommodation portion 34C includes a front base portion 40C that is thinner than the front base portion 40A of the terminal accommodation portion 34A. The terminal accommodation portion 34C further includes a right wall portion 41C, a left wall portion 42C, partition wall portions 43C, cavities 44C (cavities 44), recessed portions 50C, and elastic locking pieces 51C (elastic locking pieces 51) that respectively have the same shapes as those of the right wall portion 41A, the left wall portion 42A, the partition wall portions 43A, the cavities 44A, the recessed portions 50A, and the elastic locking pieces 51A of the terminal accommodation portion 34A.

The terminal accommodation portion 34C further includes a locking protrusion 55C (locking protrusion 55). The locking protrusion 55C is provided directly below the elastic locking piece 51C. The locking protrusion 55C is provided at a position corresponding to the elastic locking piece 51 of a substrate 12 arranged thereunder. The locking protrusion 55C protrudes outward in the left-right direction. The locking protrusion 55C extends in the front-rear direction, and the width in the front-rear direction is slightly smaller than the inner gap between the upright portions 53A of the elastic locking piece 51A. It should be noted that the left wall portion 42C is also provided with a locking protrusion 55C that is symmetrical to the locking protrusion 55C provided on the right wall portion 41C.

The sheet-like member placement portion 35C includes a rear base portion 60C, a right rib 61C, and a left rib 62C. The rear base portion 60C is different from the rear base portion 60A in that the rear base portion 60C is thinner than the rear base portion 60A, otherwise the shapes of the other portions are the same as those of the rear base portion 60A. The right rib 61C is different from the right rib 61A in that the right rib 61C is provided with a right through hole 36C passing through the right rib 61C in the thickness direction, otherwise the shapes of the other portions are the same as those of the right rib 61A. The right through hole 36C is formed at a position corresponding to the right posts 32A and 32B, and can be fitted to any of the posts 32. The left rib 62C is different from the left rib 62A in that the left rib 62C is provided with a left through hole 37C passing through the left rib 62C in the thickness direction, otherwise the shapes of the other portions are the same as those of the left rib 62A. The left through hole 37C is formed at a position corresponding to the left post 33A, and can be fitted to any of the posts 32.

The type-2 upper substrate 30D has substantially the same shape as that of the type-2 bottom substrate 30B in a plan view. The type-2 upper substrate 30D includes a terminal accommodation portion 34D, and a sheet-like member placement portion 35D. The terminal accommodation portion 34D has the same shape as that of the terminal accommodation portion 34C of the type-1 upper substrate 30C. That is to say, the terminal accommodation portion 34D includes a front base portion 40D, a right wall portion 41D, a left wall portion 42D, partition wall portions 43D, cavities 44D (cavities 44), recessed portions 50D, and elastic locking pieces 51D (elastic locking pieces 51) that respectively have the same shapes as those of the front base portion 40C, the right wall portion 41C, the left wall portion 42C, the partition wall portions 43C, the cavities 44C, the recessed portions 50C, and the elastic locking pieces 51C.

The sheet-like member placement portion 35D includes a rear base portion 60D, a right rib 61D, and a left rib 62D. The rear base portion 60D and the right rib 61D respectively have the same shapes as those of the rear base portion 60C and the right rib 61C. The left rib 62D is different from the left rib 62C of the type-1 upper substrate 30C in that the width in the left-right direction is smaller than the diameter of the left post 33A and the outer side face is recessed inward from the outer side face of the left wall portion 42D, otherwise the shapes of the other portions are the same as those of the left rib 62C of the type-1 upper substrate 30C.

The type-3 upper substrate 30E has a shape symmetrical to the shape of the type-2 upper substrate 30D. The type-3 upper substrate 30E includes a terminal accommodation portion 34E and a sheet-like member placement portion 35E. The terminal accommodation portion 34E has the same shape as that of the terminal accommodation portion 34C of the type-1 upper substrate 30C. That is to say, the terminal accommodation portion 34E includes a front base portion 40E, a right wall portion 41E, a left wall portion 42E, partition wall portions 43E, cavities 44E (cavities 44), recessed portions 50E, and elastic locking pieces 51E (elastic locking pieces 51) that respectively have the same shapes as those of the front base portion 40C, the right wall portion 41C, the left wall portion 42C, the partition wall portions 43C, the cavities 44C, the recessed portions 50C, and the elastic locking pieces 51C.

The sheet-like member placement portion 35E includes a rear base portion 60E, a right rib 61E, and a left rib 62E. The rear base portion 60E and the left rib 62E respectively have the same shapes as those of the rear base portion 60C and the left rib 62C of the type-1 upper substrate 30C. The right rib 61E is different from the right rib 61C of the type-1 upper substrate 30C in that the width in the left-right direction is smaller than the diameter of the right post 32A and the outer side face is recessed inward from the outer side face of the right wall portion 41E, otherwise the shapes of the other portions are the same as those of the right rib 61C of the type-1 upper substrate 30C.

The above-described type-1 upper substrate 30C, type-2 upper substrate 30D, and type-3 upper substrate 30E serve as the upper substrates 14 in which the first terminal fittings 3A can be accommodated. Although not shown, a type-4 upper substrate and a type-5 upper substrate in which the second terminal fittings 3B can be accommodated are provided as the upper substrates 14 in addition to the type-1 upper substrate 30C, type-2 upper substrate 30D, and type-3 upper substrate 30E. The type-4 upper substrate has the same shape as that of the type-1 upper substrate 30C, except that the widths and heights of the cavities 44C are larger and cutout portions that can be filled by lower protrusions 57H and 57I of the cover substrate 15, which will be described later, are formed in the upper face. The type-5 upper substrate has the same shape as that of the type-2 upper substrate 30D, except that the widths and heights of the cavities 44C are larger and cutout portions that can be filled by lower protrusions 57H and 57I, which will be described later, are formed in the upper face.

Types of Cover Substrate 15

A type-1 cover substrate 30H provided with through holes 36 passing therethrough in the thickness direction on both the left and right sides thereof, and a type-2 cover substrate 30I provided with a through hole 36 passing therethrough in the thickness direction on only one of the left and right sides thereof (on the left side in Embodiment 1) are provided as the cover substrates 15. All of the cover substrates 15 have a substantially flat shape and have a substantially square shape in a plan view.

The type-1 cover substrate 30H has substantially the same shape as those of the type-1 bottom substrate 30A and the type-1 upper substrate 30C in a plan view. The type-1 cover substrate 30H includes a front base portion 40H that forms the approximate front half, and a rear base portion 60H that forms the approximate rear half. Each of the left and right side faces of the front base portion 40H is provided with a recessed portion 50H. The recessed portions 50H are formed extending over the entire regions of the left and right side faces of the front base portion 40H in the vertical direction. Each of the recessed portions 50H is provided with a locking protrusion 55H (locking protrusion 55) that has the same shape as that of the locking protrusion 55C of the type-1 upper substrate 30C. The locking protrusions 55H are formed at positions corresponding to the elastic locking pieces 51 of the substrate 12 arranged thereunder. Portions on both the left and right sides of the front base portion 40H that are located on the front side with respect to the recessed portions 50H are provided with upper protrusions 56H that protrude upward from the upper face. The upper protrusions 56H are formed extending in the front-rear direction. The front rear end portion of the front base portion 40H is provided with a lower protrusion 57 that protrudes downward from the underside. The lower protrusion 57 extends in the left-right direction, and is formed extending over the entire region of the front base portion 40H in the left-right direction.

Both the left and right side faces of the rear base portion 60H protrude outward in the left-right direction from the side faces of the front base portions 40H. The rear base portion 60H is provided with a right through hole 36H (through hole 36) passing therethrough in the thickness direction in the right end portion (more specifically, the rear end portion of the right end portion), and a left through hole 37H (through hole 36) passing therethrough in the thickness direction in the left end portion (more specifically, the rear end portion of the left end portion). The right through hole 36H and the left through hole 37H can be fitted to any of the posts 32.

The type-2 cover substrate 30I has substantially the same shape as that of the type-3 upper substrate 30E in a plan view. The type-2 cover substrate 30I includes a front base portion 40I and a rear base portion 60I. The front base portion 40I has the same shape as that of the front base portion 40H of the type-1 cover substrate 30H. That is to say, the front base portion 40I includes recessed portions 50I, upper protrusions 56I, and a lower protrusion 57I that respectively have the same shapes as those of the recessed portions 50H, the upper protrusions 56H, and the lower protrusion 57H of the front base portion 40H.

In the rear base portion 60I, one of the left and right side faces (left side face in Embodiment 1) protrudes outward in the left-right direction from the side face of the front base portion 40I, and the other (right side face in Embodiment 1) is recessed inward in the left-right direction from the side face of the front base portion 40I. One of the left and right end portions (left end portion in this embodiment) of the rear base portion 60I is provided with a left through hole 37I (through hole 36) passing therethrough in the thickness direction. More specifically, the left through hole 37I is provided in the rear end portion of the left end portion of the rear base portion 60I.

Assembly of Connector 1

A process for assembling the connector 1 including three substrate stacks 11 will be described with reference to FIGS. 16 to 21. It should be noted that, in FIGS. 16 to 21, the leftmost substrates 12 of the substrates lined up in a row in the left-right direction are the first substrates 12A included in the first substrate stack 11A, the rightmost substrates 12 are the second substrates 12B included in the second substrate stack 11B, and the center substrates 12 are the addition substrates 12C included in the addition substrate stack 11C.

Figure 16:
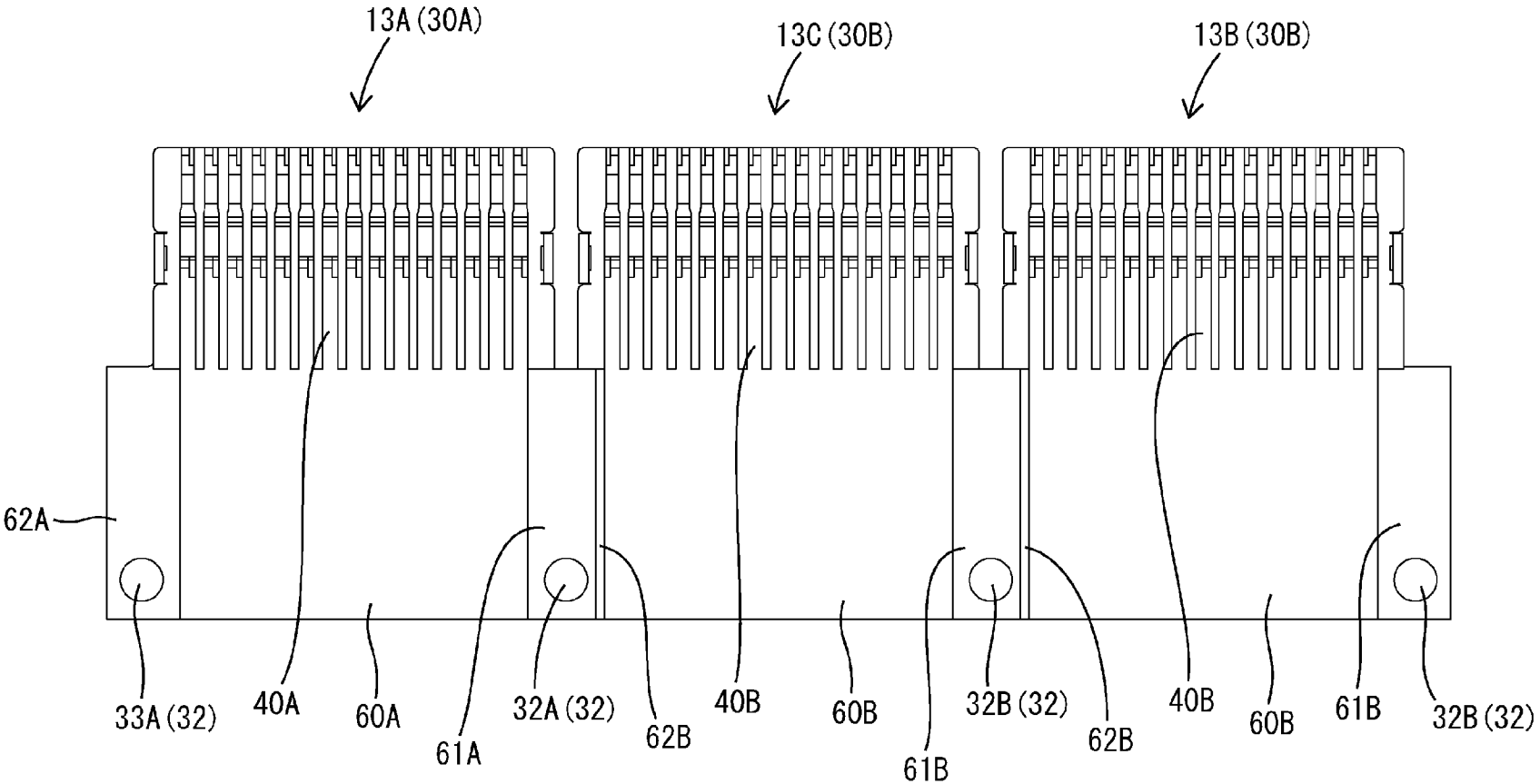
FIG. 16 is a plan view showing a state in which the first layer of the connector main body is provided.
Figure 17:
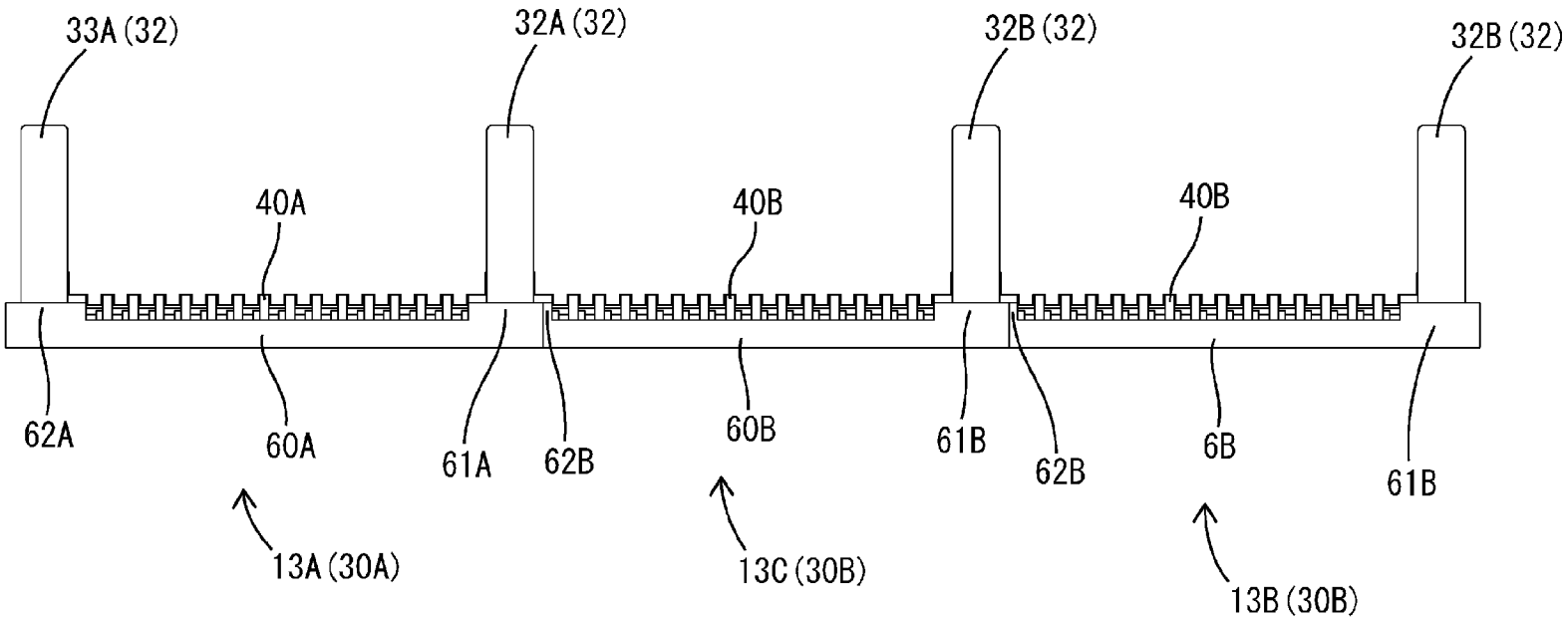
FIG. 17 is a front view showing the state in which the first layer of the connector main body is provided.

First, as shown in FIGS. 16 and 17, the bottom substrates 13 are lined up in order to form the lowermost layers of the substrate stacks 11. Specifically, the type-1 bottom substrate 30A is arranged as the first bottom substrate 13A for forming the lowermost layer of the first substrate stack 11A, and the type-2 bottom substrates 30B are arranged as the bottom substrates 13 (the second bottom substrate 13B and the addition bottom substrate 13C) for forming the lowermost layers of the other substrate stacks 11 (the second substrate stack 11B and the addition substrate stack 11C).

The bottom substrates 13 are arranged in a state in which the side faces of the adjacent sheet-like member placement portions 35 are in contact with each other in the left-right direction, and the terminal accommodation portions 34 are spaced apart from each other in the left-right direction. The upper substrates 14 are also arranged in the same positional relationship.

Figure 18:
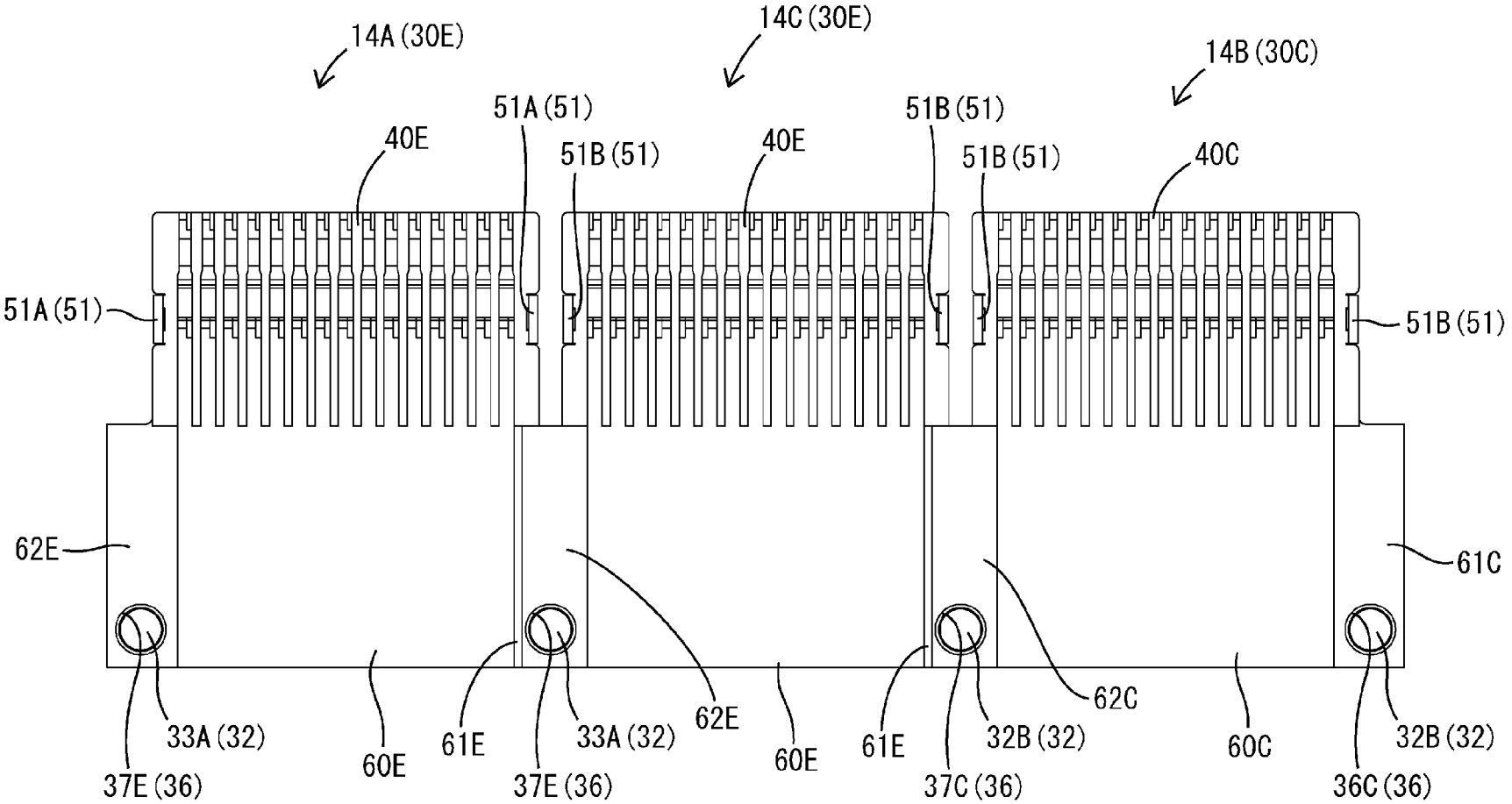
FIG. 18 is a plan view showing a state in which the second layer of the connector main body is provided.
Figure 19:
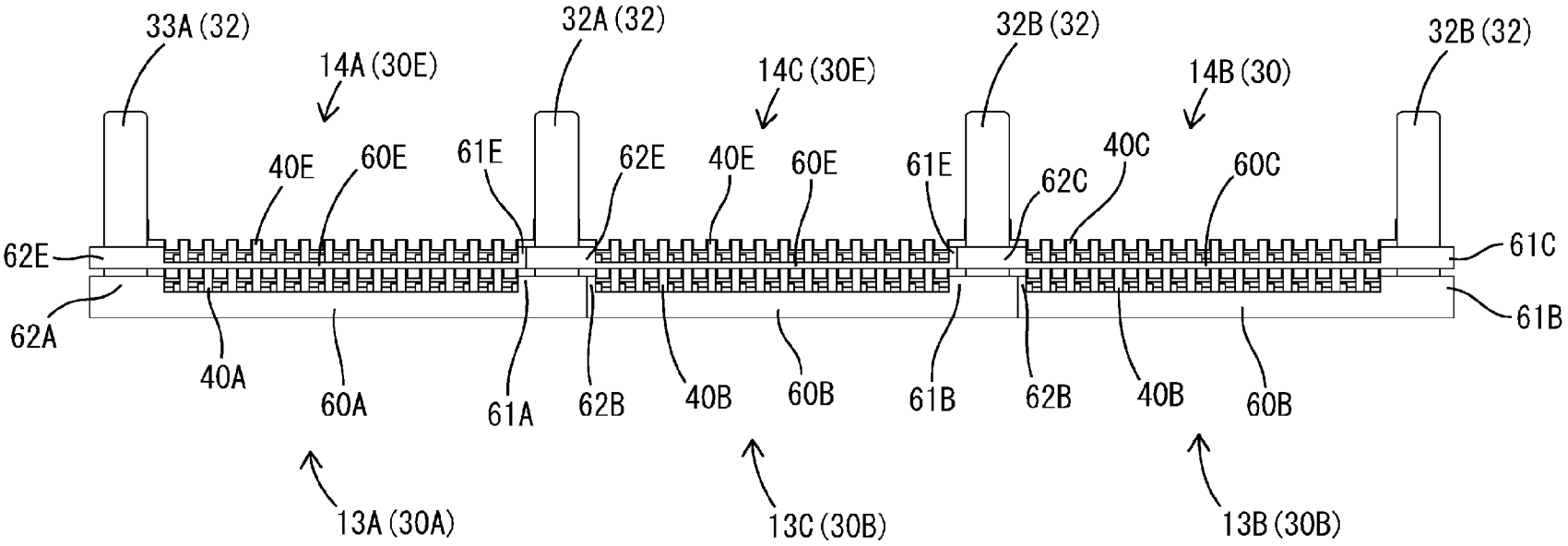
FIG. 19 is a front view showing the state in which the second layer of the connector main body is provided.

After the bottom substrates 13 have been arranged as the lowermost layers, the upper substrates 14 are stacked as the second layers from the lowermost layers on the bottom substrates 13. As shown in FIGS. 18 and 19, in the second layers from the lowermost layers, the type-1 upper substrate 30C is stacked as the second upper substrate 14B included in the second substrate stack 11B, and the type-3 upper substrates 30E are stacked as the upper substrates 14 (the first upper substrate 14A and the addition upper substrate 14C) included in the other substrate stacks 11 (the first substrate stack 11A and the addition substrate stack 11C).

In the second upper substrate 14B of the second layer, the right through hole 36C is fitted to the right post 32B of the second bottom substrate 13B, the left through hole 37C is fitted to the right post 32B of the addition bottom substrate 13C, and the locking protrusions 55 are locked to the elastic locking pieces 51 of the second bottom substrate 13B (the second substrate 12B thereunder). As a result, the second upper substrate 14B is locked to the second bottom substrate 13B so as not to be displaced relative to the second bottom substrate 13B, and is coupled to the addition bottom substrate 13C while this locking state is firmly maintained due to the right through hole 36C being fitted to the right post 32B. Accordingly, the right post 32B of the addition bottom substrate 13C corresponds to the "addition post" of the present invention, and the left through hole 37C of the second upper substrate 14B of the second layer corresponds to the "coupling hole" of the present invention. In two substrates 12 arranged one on top of the other as is the case with the second bottom substrate 13B and the second upper substrate 14B of the second layer, the terminal accommodation portions 34 are in contact with each other, and a gap is formed between the sheet-like member placement portions 35. The wire harness 2 is attached in this gap. A method for attaching a wire harness 2 will be described later.

In the addition upper substrate 14C of the second layer, the left through hole 37E is fitted to the right post 32A of the first bottom substrate 13A, and the locking protrusions 55 are locked to the elastic locking pieces 51 of the addition bottom substrate 13C (the substrate 12 thereunder). As a result, the addition upper substrate 14C is locked to the addition bottom substrate 13C (the substrate 12 thereunder) so as not to be displaced relative to the addition bottom substrate 13C, and is coupled to the first bottom substrate 13A. Accordingly, the right post 32A of the first bottom substrate 13A corresponds to the "coupling post" of the present invention, and the left through hole 37E of the addition upper substrate 14C of the second layer corresponds to the "addition hole" of the present invention.

In the first upper substrate 14A of the second layer, the left through hole 37E is fitted to the left post 33A of the first bottom substrate 13A, and the locking protrusions 55 are locked to the elastic locking pieces 51 of the first bottom substrate 13A (the first substrate 12A thereunder). As a result, the first upper substrate 14A is locked to the first bottom substrate 13A (the substrate 12 thereunder) so as not to be displaced relative to the first bottom substrate 13A, and this locking state is firmly maintained due to the left through hole 37E being fitted to the left post 33A.

In the third layers from the lowermost layers, although not shown, the type-1 upper substrate 30C is stacked as the first upper substrate 14A included in the first substrate stack 11A, and the type-2 upper substrates 30D are stacked as the upper substrates 14 (the second upper substrate 14B and the addition upper substrate 14C) included in the other substrate stacks 11 (the second substrate stack 11B and the addition substrate stack 11C).

In the first upper substrate 14A of the third layer, the left through hole 37C is fitted to the left post 33A of the first bottom substrate 13A, the right through hole 36C is fitted to the right post 32A of the first bottom substrate 13A, and the locking protrusions 55 are locked to the elastic locking pieces 51 of the first upper substrate 14A thereunder. As a result, the first upper substrate 14A of the third layer is locked to the first upper substrate 14A thereunder so as not to be displaced relative to the first upper substrate 14A thereunder, and is held so as not to be displaced in the horizontal direction relative to the first bottom substrate 13A due to the two through holes 36 being fitted to the posts 32. The addition substrate 12C of the third layer is provided with no left through hole 37C and does not interfere with the first upper substrate 14A of the third layer in the vertical direction. Accordingly, the right through hole 36C of the first upper substrate 14A of the third layer corresponds to the "second reinforcement hole" of the present invention. In a case where the second substrate stack 11B is coupled to the first substrate stack 11A, the right through hole 36C of the first upper substrate 14A of the third layer corresponds to the "first reinforcement hole" of the present invention.

In the addition upper substrate 14C of the third layer, the right through hole 36D is fitted to the right post 32B of the addition bottom substrate 13C, and the locking protrusions 55 are locked to the elastic locking pieces 51 of the addition upper substrate 14C thereunder. As a result, the addition upper substrate 14C of the third layer is locked to the addition upper substrate 14C arranged thereunder so as not to be displaced relative to the addition upper substrate 14C arranged thereunder, and is held so as not to be displaced in the horizontal direction relative to the addition bottom substrate 13C.

In the second upper substrate 14B of the third layer, the right through hole 36D is fitted to the right post 32B of the second bottom substrate 13B, and the locking protrusions 55 are locked to the elastic locking pieces 51 of the second upper substrate 14B thereunder. As a result, the second upper substrate 14B of the third layer is locked to the second upper substrate 14B arranged thereunder so as not to be displaced relative to the second upper substrate 14B arranged thereunder, and is held so as not to be displaced in the horizontal direction relative to the second bottom substrate 13B.

In the fourth layers from the lowermost layers, the upper substrates 14 are stacked in the same manner as in the second layers from the lowermost layers.

In the fifth layers from the lowermost layers, in the same manner as in the third layers from the lowermost layers, the first upper substrate 14A provided with the through holes 36 on both the left and right sides thereof is stacked as the first upper substrate 14A included in the first substrate stack 11A, and the upper substrates 14 provided with the through hole 36 on only the right side thereof are stacked as the upper substrates 14 (the second upper substrate 14B and the addition upper substrate 14C) included in the other substrate stacks 11 (the second substrate stack 11B and the addition substrate stack 11C). It should be noted that the upper substrate 14 made for the second terminal fittings 3B is stacked instead of the upper substrate 14 made for the first terminal fittings 3A. That is to say, the type-4 upper substrate is stacked as the first upper substrate 14A included in the first stack 11A, and the type-5 upper substrates are stacked as the upper substrates 14 (the second upper substrate 14B and the addition upper substrate 14C) included in the other substrate stacks 11 (the second substrate stack 11B and the addition substrate stack 11C).

The sixth layers from the lowermost layers are the uppermost layers of the substrate stacks 11, and the cover substrates 15 are stacked as these layers. Specifically, the type-1 cover substrate 30H is stacked as the second cover substrate 15B included in the second substrate stack 11B, and the type-2 cover substrates 30I are stacked as the cover substrates 15 (the first cover substrate 15A and the addition cover substrate 15C) included in the other substrate stacks 11 (the first substrate stack 11A and the addition substrate stack 110.

In the second cover substrate 15B, the right through hole 36H is fitted to the right post 32B of the second bottom substrate 13B, the left through hole 37H is fitted to the right post 32B of the addition bottom substrate 13C, and the locking protrusions 55 are locked to the elastic locking pieces 51 of the second upper substrate 14B thereunder. As a result, the second cover substrate 15B is locked to the second upper substrate 14B thereunder so as not to be displaced relative to the second upper substrate 14B thereunder, and is coupled to the addition bottom substrate 13C while being held so as not to be displaced in the horizontal direction relative to the second bottom substrate 13B. The second substrate stack 11B is assembled and is coupled to the addition substrate stack 11C in this manner.

In the addition cover substrate 15C, the left through hole 37I is fitted to the right post 32A of the first bottom substrate 13A, and the locking protrusions 55 are locked to the elastic locking pieces 51 of the addition upper substrate 14C thereunder. As a result, the addition cover substrate 15C is locked to the addition upper substrate 14C thereunder so as not to be displaced relative to the addition upper substrate 14C thereunder, and is coupled to the first bottom substrate 13A. The addition substrate stack 11C is assembled and is coupled to the first substrate stack 11A and the second substrate stack 11B in this manner.

In the first cover substrate 15A, the left through hole 37I is fitted to the left post 33A of the first bottom substrate 13A, and the locking protrusions 55 are locked to the elastic locking pieces 51 of the first upper substrate 14A thereunder. As a result, the first cover substrate 15A is locked to the first upper substrate 14A thereunder so as not to be displaced relative to the first upper substrate 14A thereunder, and is held so as not to be displaced in the horizontal direction relative to the first bottom substrate 13A. The first substrate stack 11A is assembled and is coupled to the addition substrate stack 11C in this manner.

The cutout portions formed in the upper faces of the type-4 upper substrate and the type-5 upper substrate can be filled by the lower protrusions 57H and 57I of the cover substrates 15. The type-1 upper substrate 30C, the type-2 upper substrate 30D, and the type-3 upper substrate 30E are not provided with the cutout portions that can be filled by the lower protrusions 57H and 57I of the cover substrates 15, and therefore, if the cover substrates 15 are stacked thereon, the cover substrates 15 will separate therefrom by the heights of the protrusions and will not be locked thereto. Accordingly, it is possible to prevent an upper substrate 14 that really should not be arranged under the cover substrate 15 to be stacked from being stacked there by mistake.

The connector main body 10 is assembled as described above. Accordingly, in the first substrate stack 11A, the first substrates 12A provided with one through hole 36 (i.e., the type-3 upper substrates 30E and the type-2 cover substrate 30I) and the first substrates 12A provided with two through holes 36 (i.e., the type-1 upper substrates 30C) are alternately stacked on the first bottom substrate 13A. In other words, the first substrates 12A provided with no second reinforcement hole (the right through hole 36C provided in the first substrates 12A forming the third layer and the fifth layer) (i.e., type-3 upper substrates 30E and the type-2 cover substrate 30I) and the first substrates 12A provided with the second reinforcement hole (the right through hole 36C provided in the first substrates 12A forming the third layer and the fifth layer) (i.e., the type-1 upper substrates 30C) are alternately stacked.

In the second substrate stack 11B, the second substrates 12B provided with two through holes 36 (i.e., the type-1 upper substrates 30C and the type-1 cover substrate 30H) and the second substrates 12B provided with one through hole 36 (i.e., the type-2 upper substrates 30D) are alternately stacked on the second bottom substrate 13B. In other words, the second substrates 12B provided with the coupling hole (the through hole 36 provided in the second substrates 12B forming the second layer, the fourth layer, and the sixth layer) (i.e., the type-1 upper substrates 30C and the type-1 cover substrate 30H) and the second substrates 12B provided with no coupling hole (the through hole 36 provided in the second substrates 12B forming the second layer, the fourth layer, and the sixth layer) (i.e., the type-2 upper substrates 30D) are alternately stacked.

In the addition substrate stack 11C, the second substrates 12B provided with the left through hole 37E (i.e., the type-3 upper substrates 30E and the type-2 cover substrate 30I) and the second substrates 12B provided with the right through hole 36D (i.e., the type-2 upper substrate 30D) are alternately stacked on the addition bottom substrate 13C. In other words, the second substrates 12B provided with the addition hole (the left through hole 37E or 37I provided in the addition substrates 12C forming the second layer, the fourth layer, and the sixth layer) (i.e., the type-3 upper substrates 30E and the type-2 cover substrate 30I) and the second substrates 12B provided with no addition hole (the left through hole 37E or 37I provided in the addition substrates 12C forming the second layer, the fourth layer, and the sixth layer) (i.e., the type-2 upper substrates 30D) are alternately stacked.

All of the first substrates 12A stacked on the first bottom substrate 13A are fitted to the left post 33A of the first bottom substrate 13A. The addition substrates 12C and the first substrates 12A are alternately fitted to the right post 32A of the first bottom substrate 13A. At this time, the addition substrates 12C and the first substrates 12A do not interfere with each other in the vertical direction, and the terminal accommodation portions 34 are alternately stacked. The second substrates 12B and the addition substrates 12C are alternately fitted to the right post 32B of the addition bottom substrate 13C. At this time, the second substrates 12B and the addition substrates 12C do not interfere with each other in the vertical direction, and the terminal accommodation portions 34 are alternately stacked. All of the second substrates 12B stacked on the second bottom substrate 13B are fitted to the right post 32B of the second bottom substrate 13B.

In the layers at the same height, the sheet-like member placement portions 35 (i.e., the rear base portions 60A, 60B, 60C, 60D, 60E, 60H, and 60I) of the adjacent substrates 12 are in contact with each other. This allows the substrates 12 to mutually restrict rotation on the horizontal plane.

In the above description, the method for assembling the connector main body 10 has been described. A single wire harness 2 is attached to the connector main body 10 every time a layer of the connector main body 10 is formed. In Embodiment 1, the first wire harnesses 2A are attached between the first and second layers, the second and third layers, the third and fourth layers, and the fourth and fifth layers, and the second wire harness 2B is attached between the fifth and sixth layers.

Figure 20:
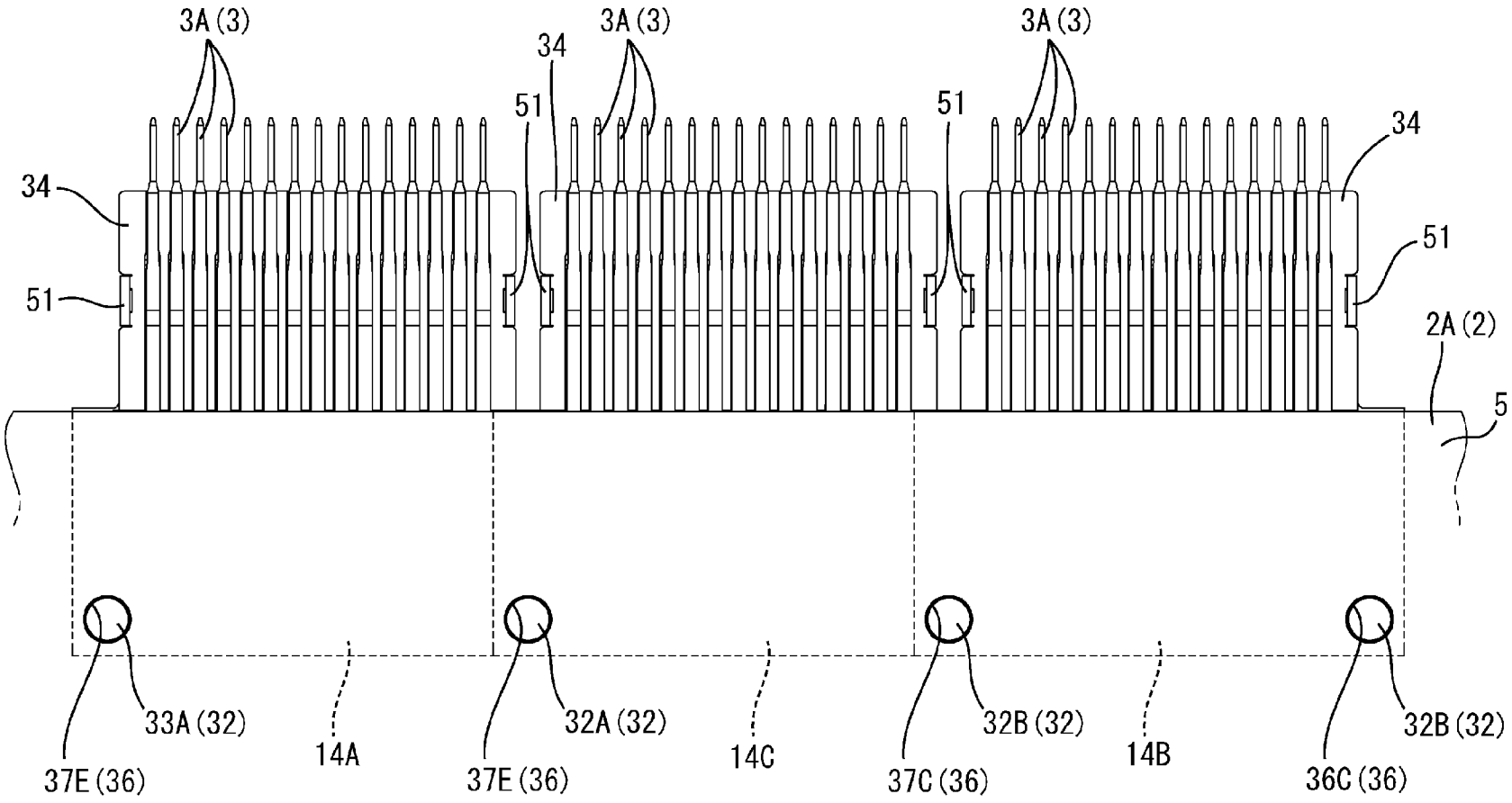
FIG. 20 is a plan view showing a state in which wire harnesses are respectively arranged on the upper faces of the first to fourth layers of the connector main body.

For example, as shown in FIG. 20, after the fourth layers have been formed, the first wire harness 2A is attached to the connector main body 10 by passing all of the posts 32 through the sheet-like member 5 of the first wire harness 2A. The thus-attached first wire harness 2A is placed on the upper face of the sheet-like member placement portions 35 of the upper substrates 14 forming the fourth layers. The first wire harness 2A is arranged so as not to protrude from the upper faces of the terminal accommodation portions 34. The first terminal fittings 3A of the first wire harness 2A are accommodated in the cavities 44 of the terminal accommodation portions 34 of the upper substrates 14 forming the fourth layers. The positioning of the first terminal fittings 3A is performed by moving the first terminal fittings 3A forward from positions on the rear side with respect to the cavities 44 and bringing them into contact with the inner wall faces of the cavities 44. In addition, after the fifth layers have been stacked, the first wire harness 2A is accommodated in the gap formed between the sheet-like member placement portions 35 of the upper substrates 14 forming the fourth and fifth layers.

Figure 21:
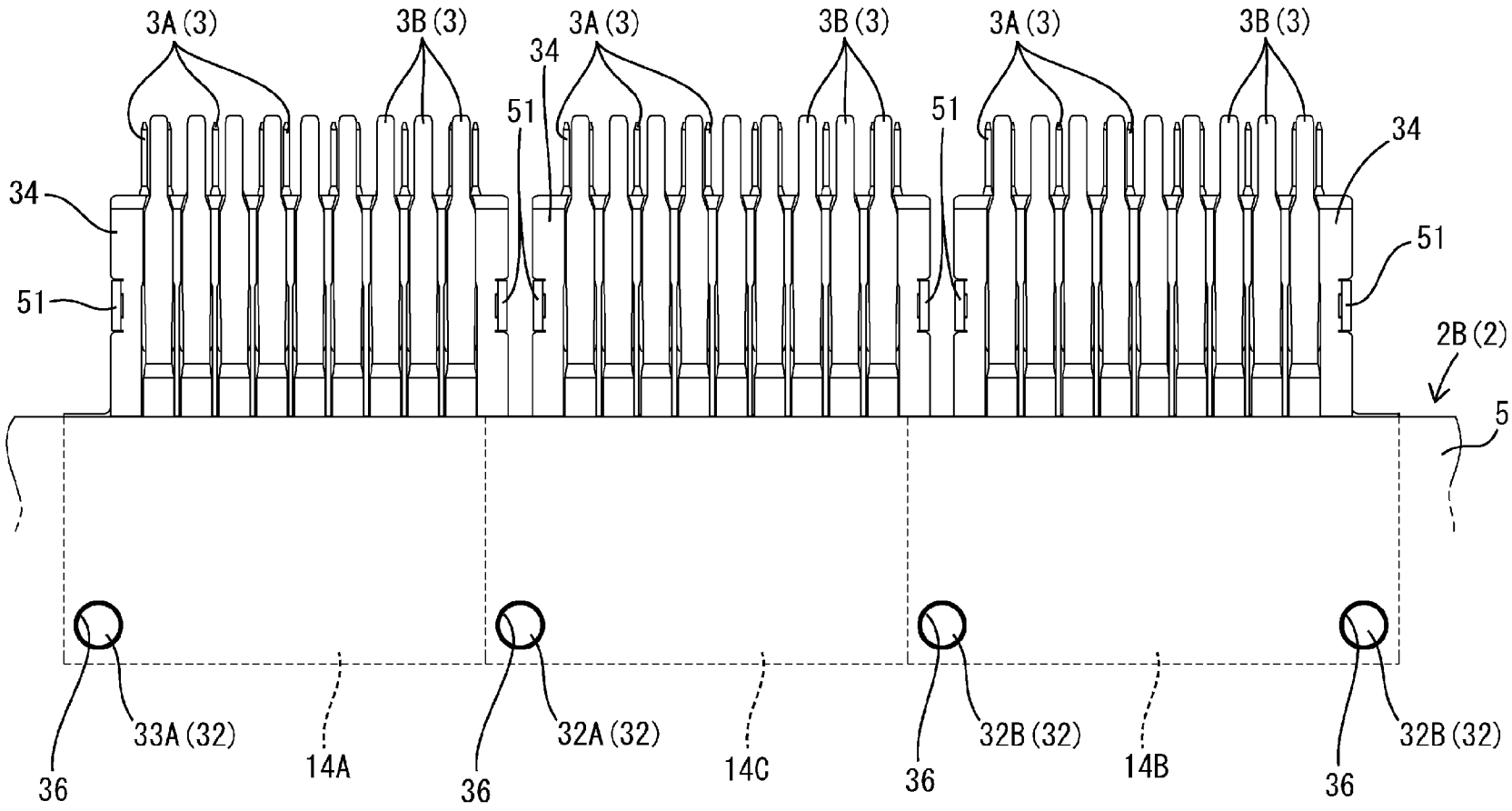
FIG. 21 is a plan view showing a state in which wire harnesses are respectively arranged on the upper faces of the first to fifth layers of the connector main body.

As shown in FIG. 21, after the fifth layers have been formed, the second wire harness 2B is attached to the connector main body 10 by passing all of the posts 32 through the sheet-like member 5 of the second wire harness 2B. A method for arranging the second wire harness 2B is the same as the above-described method for arranging the first wire harness 2A. After the second wire harness 2B has been attached, the cover substrates 15 are finally stacked. The connector 1 is thus assembled.

Functions and Effects of Embodiment 1

The connector 1 of Embodiment 1 includes the wire harness 2 and the connector main body 10 to which the wire harness 2 is attached. The connector main body 10 includes: the first substrate stack 11A in which a plurality of first substrates 12A are held in a vertically stacked state; the first bottom substrate 13A that forms the lowermost first substrate 12A of the first substrate stack 11A and includes the coupling post (the right post 32A) extending upward from the upper face; and the second substrate stack 11B that is arranged on a lateral side of the first substrate stack 11A and in which a plurality of second substrates 12B are held in a vertically stacked state, and at least one of the plurality of second substrates 12B included in the second substrate stack 11B is provided with the coupling hole (the left through hole 37C or 37H provided in the second substrates 12B forming the second layer, the fourth layer, and the sixth layer) that can be fitted to the coupling post (the right post 32A).

With this connector 1, fitting the coupling hole provided in the second substrate 12B included in the second substrate stack 11B (the left through hole 37C or 37H provided in the second substrates 12B forming the second layer, the fourth layer, and the sixth layer) to the coupling post (the right post 32A) provided on the first bottom substrate 13A makes it possible to couple the first substrate stack 11A and the second substrate stack 11B side by side without using an additional coupling member.

The connector 1 of Embodiment 1 has a configuration in which at least one of the plurality of first substrates 12A included in the first substrate stack 11A is stacked in a non-interfered state as a layer located at the same height as the second substrate 12B that is not provided with a coupling hole, and is provided with the first reinforcement hole (the right through hole 36 provided in the first substrates 12A forming the third layer and the fifth layer) that can be fitted to the coupling post (the right post 32A).

With this configuration, it is possible to not only couple the first substrate stack 11A and the second substrate stack 11B to each other without using an additional coupling member but also more firmly maintain the stacked state of the first substrate stack 11A by utilizing the coupling post.

The connector main body 10 of Embodiment 1 includes: the addition substrate stack 11C that can be arranged between the first substrate stack 11A and the second substrate stack 11B and in which a plurality of addition substrates 12C are held in a vertically stacked state; and the addition bottom substrate 13C that forms the lowermost addition substrate 12C of the addition substrate stack 11C. At least one of the plurality of addition substrates 12C included in the addition substrate stack 11C is provided with the addition hole (the left through hole 37E or 37I provided in the addition substrates 12C forming the second layer, the fourth layer, and the sixth layer) that can be fitted to the coupling post (the right post 32A).

With this configuration, fitting the addition hole (the left through hole 37E or 37I provided in the addition substrates 12C forming the second layer, the fourth layer, and the sixth layer) provided in the addition substrate 12C included in the addition substrate stack 11C to the coupling post (the right post 32A) provided on the first bottom substrate 13A makes it possible to couple the first substrate stack 11A and the addition substrate stack 11C side by side without using an additional coupling member. Furthermore, fitting the coupling hole (the left through hole 36 provided in the second substrates 12B forming the second layer, the fourth layer, and the sixth layer) provided in the second substrate 12B included in the second substrate stack 11B to the addition post (the right post 32B of the addition bottom substrate 13C) provided in the addition substrate stack 11C makes it possible to couple the addition substrate stack 11C and the second substrate stack 11B side by side without using an additional coupling member. Accordingly, three substrate stacks 11 can be coupled side by side without using additional coupling members.

The connector 1 of Embodiment 1 includes a plurality of addition substrate stacks 11C, and the addition hole (the left through hole 37E or 37I provided in the addition substrates 12C forming the second layer, the fourth layer, and the sixth layer) of one of the two adjacent addition substrate stacks can also be fitted to the addition post (the right post 32B of the addition bottom substrate 13C) of the other addition substrate stack.

With this configuration, fitting the addition hole (the left through hole 37E or 37I provided in the addition substrates 12C forming the second layer, the fourth layer, and the sixth layer) provided in the addition substrate 12C included in one of the adjacent two addition substrate stacks 11C to the addition post (the right post 32B of the addition bottom substrate 13C) provided on the addition substrate 12C included in the other addition substrate stack 11C makes it possible to couple the addition substrate stacks 11C side by side without using an additional coupling member. Accordingly, four or more substrate stacks 11 can be coupled side by side without using additional coupling members and increasing the number of types of members.

The connector 1 of Embodiment 1 has a configuration in which at least two of the plurality of first substrates 12A included in the first substrate stack 11A are stacked in a non-interfered state as the layers located at the same heights as the addition substrates 12C that are not provided with the addition hole, and are provided with a second reinforcement hole (the right through hole 36 provided in the first substrates 12A forming the third layer and the fifth layer) that can be fitted to the coupling post (the right post 32A of the first bottom substrate 13A).

With this configuration, it is possible to not only couple the first substrate stack 11A and the addition substrate stack 11C to each other without using an additional coupling member but also more firmly maintain the stacked state of the first substrate stack 11A by fitting the second reinforcement hole of the first substrate 12A (the right through hole 36 provided in the first substrates 12A forming the third layer and the fifth layer) to the coupling post (the right post 32A of the first bottom substrate 13A).

The wire harness 2 of Embodiment 1 has a configuration in which the electric wire 4 connected to the terminal fitting 3 is fixed to the sheet-like member 5, and is attached to the connector main body 10 by passing the coupling post (the right post 32A of the first bottom substrate 13A) through the sheet-like member 5.

With this configuration, the wire harness 2 can be attached to the connector main body 10 without using a fixture.

The first substrate stack 11A of Embodiment 1 includes the locking portion (the elastic locking piece 51 and the locking protrusion 55) that locks the first substrates 12A included in the first substrate stack 11A together at a position at which the locking portion does not interfere with the wire harness 2 in which the coupling post (the right post 32A of the first bottom substrate 13A) passes through the sheet-like member 5, and prevents the first substrates 12A from being displaced relative to each other.

With this configuration, it is possible to avoid interference between the locking portion (the elastic locking piece 51 and the locking protrusion 55) and the wire harness 2.

The locking portion (the elastic locking piece 51 and the locking protrusion 55) of Embodiment 1 includes the elastic locking piece 51 that extends upward in the form of a cantilever from the first substrate 12A; and the locking protrusion 55 that is provided on another first substrate 12A stacked on the first substrate 12A provided with the elastic locking piece 51 and is locked to the elastic locking piece 51.

With this configuration, two vertically stacked first substrates 12A can be locked to each other in a state in which the extending end portion (free end) of the elastic locking piece 51 faces upward, and thus the first substrate stack 11A is formed. Therefore, the locking state can be cancelled by hooking a fingernail on the upper end portion of the elastic locking piece 51, thus making it easy to remove the stacked first substrates 12A from above.

Other Embodiments

The present invention is not limited to the embodiment described in the description above and the drawings, and for example, the following embodiments are also included in the technical scope of the present invention.

(1) In Embodiment 1 above, the number of substrate stacks included in the connector main body is three. However, the connector main body can also be formed using two substrate stacks by directly coupling the first substrate stack and the second substrate stack to each other without using the addition substrate stack. The number of substrate stacks can also be set to any desired number greater than or equal to four by increasing the number of addition substrate stacks coupled between the first substrate stack and the second substrate stack.

(2) In Embodiment 1 above, the first bottom substrate includes only one coupling post, but the first bottom substrate may also include a plurality of coupling posts. Providing the second substrate with a plurality of coupling holes and fitting these coupling holes to the coupling posts makes it possible to prevent the first substrate stack and the second substrate stack from rotating relative to each other on the horizontal plane. Moreover, providing the addition substrate with a plurality of addition holes and fitting these addition holes to the coupling posts makes it possible to prevent the first substrate stack and the addition substrate stack from rotating relative to each other on the horizontal plane. Furthermore, providing the addition substrate with a plurality of addition posts and fitting the coupling holes to the addition posts makes it possible prevent the addition substrate stack and the second substrate stack from rotating relative to each other on the horizontal plane.

(3) The first bottom substrate may also include no posts other than the coupling post. The addition bottom substrate may also include no posts other than the addition post. The second bottom substrate may also include no posts.

(4) The first upper substrate and the first cover substrate may also be provided with no through holes. The addition upper substrate and the addition cover substrate may also be provided with no through holes other than the addition hole. The second upper substrate and the second cover substrate may also be provided with no through holes other than the coupling hole.

LIST OF REFERENCE NUMERALS

1 . . . Connector
2 . . . Wire harness
3 . . . Terminal fitting
4 . . . Electric wire
5 . . . Sheet-like member
10 . . . Connector main body
11 . . . Substrate stack
11A . . . First substrate stack
11B . . . Second substrate stack
11C . . . Addition substrate stack
12 . . . Substrate
12A . . . First substrate
12B . . . Second substrate
12C . . . Addition substrate
13 . . . Bottom substrate
13A . . . First bottom substrate
13B . . . Second bottom substrate
13C . . . Addition bottom substrate
14 . . . Upper substrate
14A . . . First upper substrate
14B . . . Second upper substrate
14C . . . Addition upper substrate
15 . . . Cover substrate
15A . . . First cover substrate

15B . . . Second cover substrate
15C . . . Addition cover substrate
32 . . . Post
32A . . . Right post (coupling post)
32B . . . Right post (addition post)
34 . . . Terminal accommodation portion
35 . . . Sheet-like member placement portion
36 . . . Through hole
36C . . . Right through hole (first reinforcement hole, second reinforcement hole)
37C . . . Left through hole (coupling hole)
37E . . . Left through hole (addition hole)
37I . . . Left through hole (addition hole)
51 . . . Elastic locking piece (corresponding to a portion of a "locking portion" of the present invention)
55 . . . Locking protrusion (corresponding to a portion of a "locking portion" of the present invention)

The invention claimed is:

1. A connector comprising:

a wire harness; and a connector main body to which the wire harness is attached, wherein the connector main body includes:

a first substrate stack in which a plurality of first substrates are held in a vertically stacked state, including a first bottom substrate that forms the lowermost first substrate of the first substrate stack and includes a coupling post extending upward from an upper face; and a second substrate stack that is arranged on a lateral side of the first substrate stack and in which a plurality of second substrates are held in a vertically stacked state, wherein at least one of the plurality of second substrates included in the second substrate stack is provided with a coupling hole configured to be fitted to the coupling post.

2. The connector according to claim 1, wherein at least one of the plurality of first substrates included in the first substrate stack is stacked in a non-interfered state as a layer located at the same height as a second substrate that is not provided with the coupling hole, and is provided with a first reinforcement hole configured to be fitted to the coupling post.

3. The connector according to claim 1, wherein the connector main body includes:

an additional substrate stack that is arranged between the first substrate stack and the second substrate stack and in which a plurality of additional substrates are held in a vertically stacked state, including an additional bottom substrate that forms the lowermost additional substrate of the additional substrate stack, wherein at least one of the plurality of additional substrates included in the additional substrate stack is provided with an additional hole configured to be fitted to the coupling post, and the additional bottom substrate includes an additional post that extends upward from an upper face and to which the coupling hole can be fitted.

4. The connector according to claim 3, comprising a plurality of the additional substrate stacks, wherein the additional hole of one of the two adjacent additional substrate stacks can also be fitted to the additional post of the other additional substrate stack.

5. The connector according to claim 3, wherein at least one of the plurality of first substrates included in the first substrate stack is stacked in a non-interfered state as a layer located at the same height as an additional substrate that is not provided with the additional hole, and is provided with a second reinforcement hole configured to be fitted to the coupling post.

6. The connector according to claim 1, wherein the wire harness has a configuration in which an electric wire connected to a terminal fitting is fixed to a sheet-like member, and is attached to the connector main body by passing the coupling post through the sheet-like member.

7. The connector according to claim 6, wherein the first substrate stack includes a locking portion that locks the first substrates included in the first substrate stack together at a position at which the locking portion does not interfere with the wire harness in which the coupling post passes through the sheet-like member, and prevents the first substrates from being displaced relative to each other.

8. The connector according to claim 7, wherein the locking portion includes:

an elastic locking piece that extends upward in the form of a cantilever from a first substrate; and a locking protrusion that is provided on another first substrate stacked on the first substrate provided with the elastic locking piece and is locked to the elastic locking piece.

* * * * *